US006938695B2

(12) United States Patent
Williams

(10) Patent No.: US 6,938,695 B2
(45) Date of Patent: Sep. 6, 2005

(54) FULLY RECOVERABLE DRILLING CONTROL POD

(75) Inventor: Grahame Williams, Houston, TX (US)

(73) Assignee: Offshore Systems, Inc., Houston, TX (US)

( * ) Notice: Subject to any disclaimer, the term of this patent is extended or adjusted under 35 U.S.C. 154(b) by 148 days.

(21) Appl. No.: 10/365,351

(22) Filed: Feb. 12, 2003

(65) Prior Publication Data

US 2004/0154804 A1 Aug. 12, 2004

(51) Int. Cl.[7] ..... E21B 33/06
(52) U.S. Cl. ..... 166/341
(58) Field of Search ..... 166/339, 341, 166/365

(56) References Cited

U.S. PATENT DOCUMENTS 4,046,192 A 9/1977 Darnborough et al.
4,328,826 A * 5/1982 Baugh ..... 137/236.1
6,032,742 A 3/2000 Tomlin et al.
2003/0180096 A1 9/2003 Appleford et al.

FOREIGN PATENT DOCUMENTS

WO WO 00/08297 2/2000

* cited by examiner

*Primary Examiner*—Sunil Singh
(74) *Attorney, Agent, or Firm*—Bracewell & Giuliani LLP

(57) ABSTRACT

A subsea well assembly has a guideframe that receives a control pod. The guideframe is in fluid communication with either a blow-out preventer (BOP), a lower marine riser package (LMRP), or both. The control pod is in communication with a vessel, and is used to control the functions of the BOP, the LMRP, or both. Electrical and hydraulic communications are established between the control pod with little or no assistance from a remote operated vehicle. A piston is used to extend a stab assembly into engagement with control panels that are in communication with the BOP and LMRP. The stab assembly can be locked in its upper position while being lowered and landed in the guideframe, and in its lower position after registering with the control panels. Springs and slideable plates help align electrical connections to the BOP and LMRP upon engagement of stab assemblies and stab receptor assemblies.

37 Claims, 13 Drawing Sheets

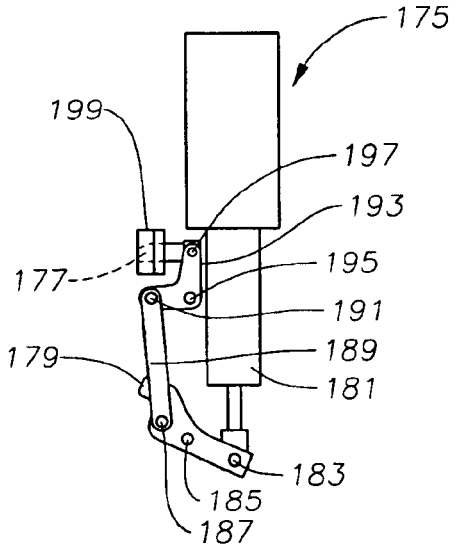
Fig. 13A
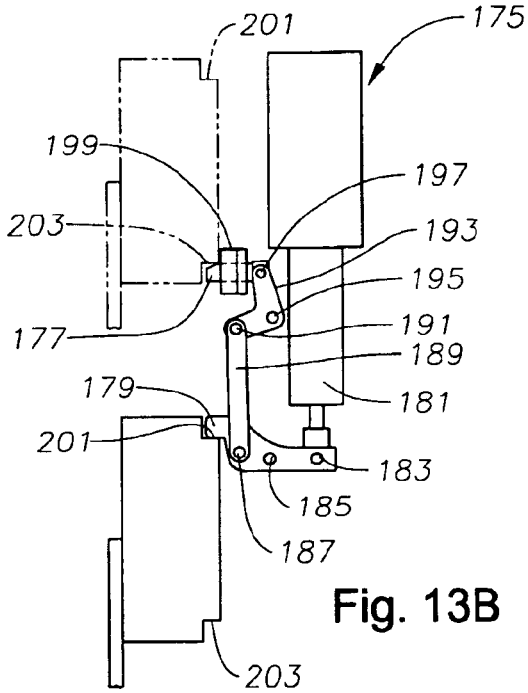
Fig. 13B
Fig. 15
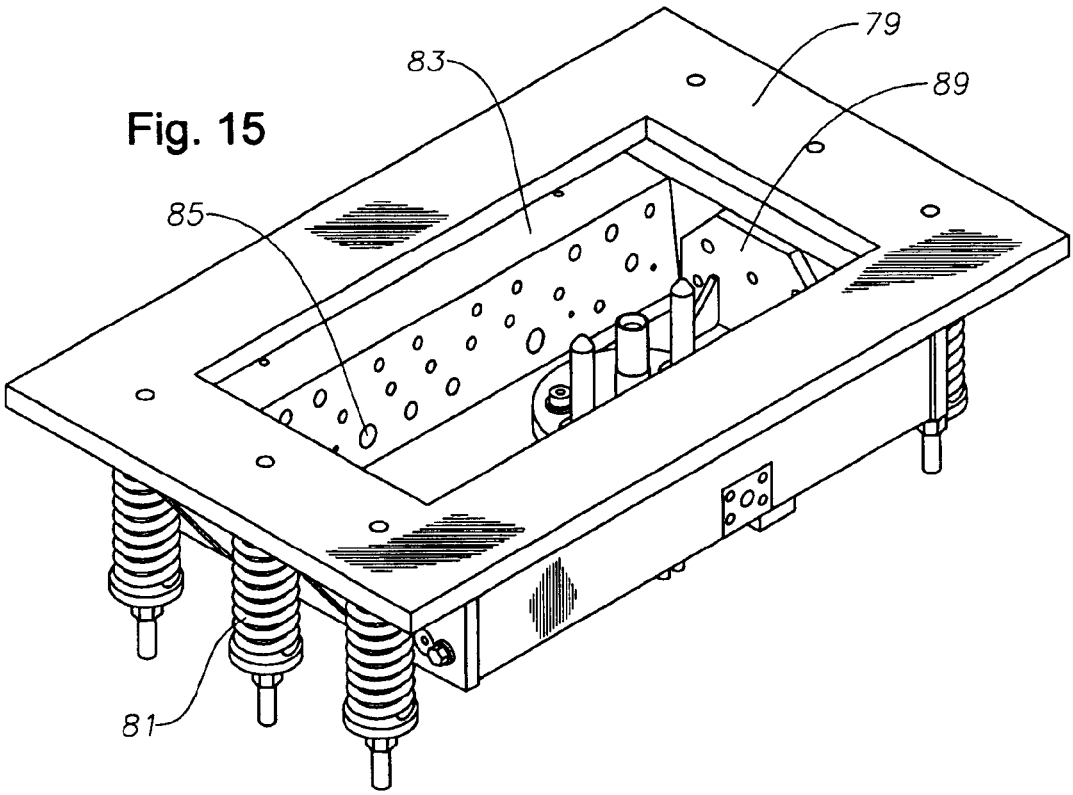

FULLY RECOVERABLE DRILLING CONTROL POD

BACKGROUND OF THE INVENTION

1. Technical Field

This invention relates in general to the communication from a subsea well to a control pod located adjacent the well, and more particularly to the connection and communication of hydraulic fluid and electricity between the control pod and a blow-out preventer and a lower marine riser package that are attached to the well.

2. Background of the Invention

A subsea well typically has safety devices attached to the well during operations when a tree assembly has not been attached to the well. These operations are typically during drilling operations, but can also be during workover and some production operations. Typically, the safety devices include both a blow-out preventer (BOP) and a lower marine riser package (LMRP) for closing the well. The BOP has an annular eleastomeric member that will close around a pipe or cable, as well as fully close the opening even if a pipe or cable is not present. The LMRP comprises a number of hydraulic rams that close on pipe. Operators use hydraulics and electricity to control and monitor the functions of the BOP and the LMRP. Therefore, the operator must be able to send and receive electrical signals and hydraulic fluids to and from the BOP and the LMRP during operations.

Control pods are typically placed adjacent the BOP and LMRP that have the capability of communicating signals from an operator on a vessel to the BOP and the LMRP. Typically the control pods either have their own, or are in communication with electrical and hydraulic sources adjacent the well assembly. In order to connect the control pod to the BOP and LMRP, operators often must use a remote operated vehicle (ROV) to connect various cables and wires between the BOP and the LMRP with the control pod. Additionally, sometimes it is desirous to monitor and control operations in the well downhole from the BOP and LMRP. Therefore, the ROV also had to connect cables and wires to the control pod for these functions. Using an ROV for the task of connecting various cables and wires between the control pod to the BOP, LMRP, and downhole equipment can be time consuming and expensive since operations cannot proceed until the electrical and hydraulic connections are made.

SUMMARY OF THE INVENTION

A subsea well assembly uses a guideframe located adjacent a well for receiving a control pod which controls the operations of the safety equipment of the well during operations. The guideframe is typically located adjacent a well having a blow-out preventer (BOP) and a lower marine riser package (LMRP) attached to the subsea well. During operations, the BOP and the LMRP are typically controlled with electricity and hydraulic fluids. The guideframe is in fluid communication with at least one of, and preferably both, the BOP and LMRP. The guideframe receives the control pod. In the preferred embodiment, the control pod has an upper electrical stab that connects to an upper electrical stab receptor located on the guideframe so that the control pod is in electrical communication with the BOP when the control pod lands in the guideframe. In the preferred embodiment, spring rods and a movable stab plate account for minor misalignments of the upper electrical stab and the upper electrical stab receptor. Upon landing the control pod, electrical communications are therefore established between the control pod and the BOP without using a remote operated vehicle (ROV) to connect cables or wires between the BOP and the control pod.

The control pod preferably includes a stab assembly that has a plurality of ports for fluid communication between the control pod and at least one, but preferably both the BOP and LMRP. The stab assembly can also be used for fluid communication with downhole equipment and the control pod. The stab assembly of the control pod is lowered from an upper position until the ports register with a control panel located adjacent the subsea well and having ports that matingly align with the ports on the stab assembly. The control panel is preferably in communication with the LMRP. Upon registering with the ports on the control panel, the control pod is preferably in fluid communication with the LMRP. Typically, the stab assembly also has a lower electrical stab mechanism assembly that connects to a lower electrical stab plate assembly so that the control pod is in electrical communication with the LMRP when the stab assembly is lowered from an upper position.

In the preferred embodiment, the control panel in communication with the LMRP is located below another control panel that is in fluid communication with the BOP and is located on the guideframe. Therefore, the control panel in communication with the LMRP defines a lower control panel, and the control panel in fluid communication with the BOP defines an upper control panel. The stab assembly preferably has ports that register with the lower control panel and ports that register with the upper control panel. In the preferred embodiment, the ports on the stab assembly register with the ports on the upper and lower control panels when the stab assembly is in its lowered position so that the control pod is in fluid communication with both the BOP and the LMRP without using the ROV to connect cables between the control pod and the guideframe.

In the preferred embodiment, the ports on the stab assembly register with the lower control panel before registering with the upper control panel. The stab assembly is in an intermediate position when the stab assembly registers with the lower control panel and not the upper control panel. The lower control panel preferably engages a spring which allows the stab assembly to push the lower control panel to a lower position. The stab assembly pushes the lower control panel in order to move from its intermediate position to its lowered position. In the lower position, the ports on the stab assembly register with the upper control panel, and the control pod is in communication with the BOP.

The control pod preferably includes a lock mechanism assembly that engages portions of the stab assembly to prevent the stab assembly from moving relative to the upper and lower control panels when the lock mechanism is in a locked position. The stab assembly moves freely between its upper, intermediate, and lower positions when the lock mechanism assembly is in an unlocked position. The lock mechanism assembly engages the stab assembly when the stab assembly is either in its upper or lower positions.

BRIEF DESCRIPTION OF THE DRAWINGS

FIG. 13A is a schematic view of a lock mechanism assembly for locking the stab assembly in its upper and lower positions shown in FIGS. 4A and 4D, wherein the lock mechanism assembly is in an unlocked position.

FIG. 13B is a schematic view of the lock mechanism assembly of FIG. 13A, wherein the lock mechanism assembly is in a locked position.

FIG. 15 is a perspective view of the lower support plate shown in FIG. 1A, supporting the lower control panels shown in FIGS. 4A–4D and the lower electric stab plate assembly shown in FIG. 10.

DETAILED DESCRIPTION OF THE PREFERRED EMBODIMENT

Figure 1A:
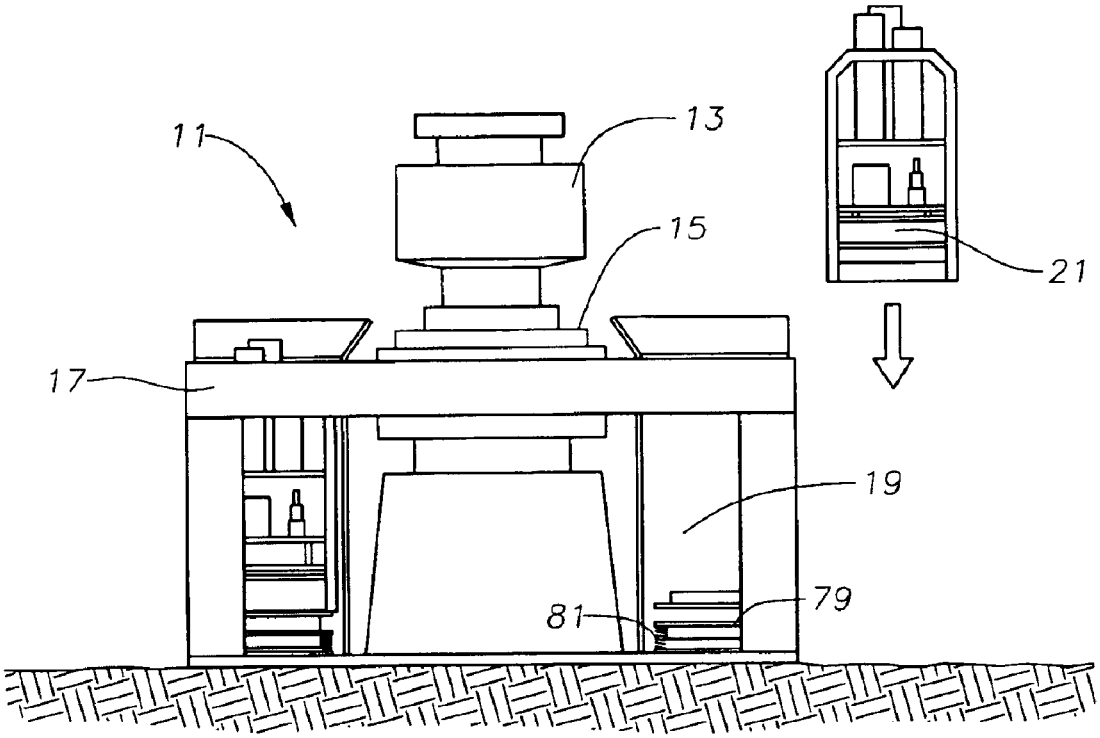
FIG. 1A is a perspective view of a control pod being lowered adjacent a well assembly constructed in accordance with this invention.

Referring to FIGS. 1A–1D, an upper portion of a subsea well assembly 11 is shown. A blow-out preventer (BOP) 13 and a lower marine riser package (LMRP) 15 are connected to wellhead assembly 11. BOP 13 and LMRP 15 are known in the art as safety devices for use in drilling and production operations. Typically, a riser (not shown) extends from a vessel to BOP 13 so that the vessel is in communication with the well during operations before a tree assembly is attached to well assembly 11. A main frame 17 surrounds well assembly 11. Frame 17 is in electrical and hydraulic communication with BOP 13 and LMRP 15. A control pod guideframe 19 is part of frame 17. In the preferred embodiment, for redundancy there are two control pod guideframes 19, one located on each side of BOP 13 and LMRP 15. Each control pod guideframe 19 receives a control pod 21 for controlling the operations of BOP 13 and LMRP 15.

Figure 1B:
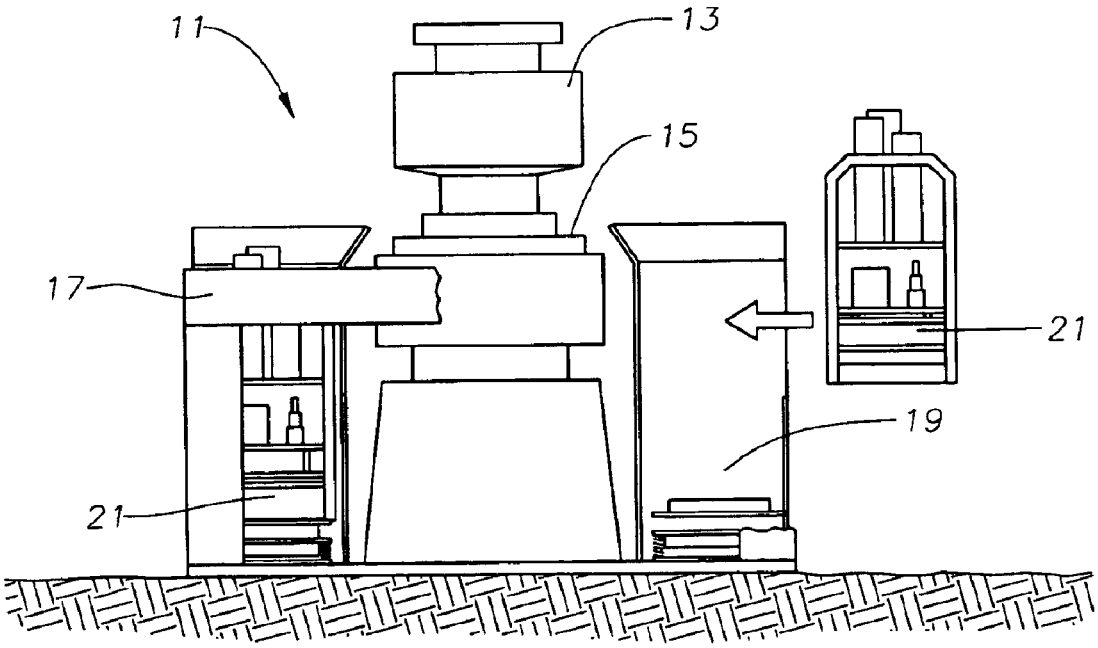
FIG. 1B is a partial sectional view of the well assembly and control pod of FIG. 1A, with the control pod being maneuvered to a position above a guideframe that receives the control pod.
Figure 1C:
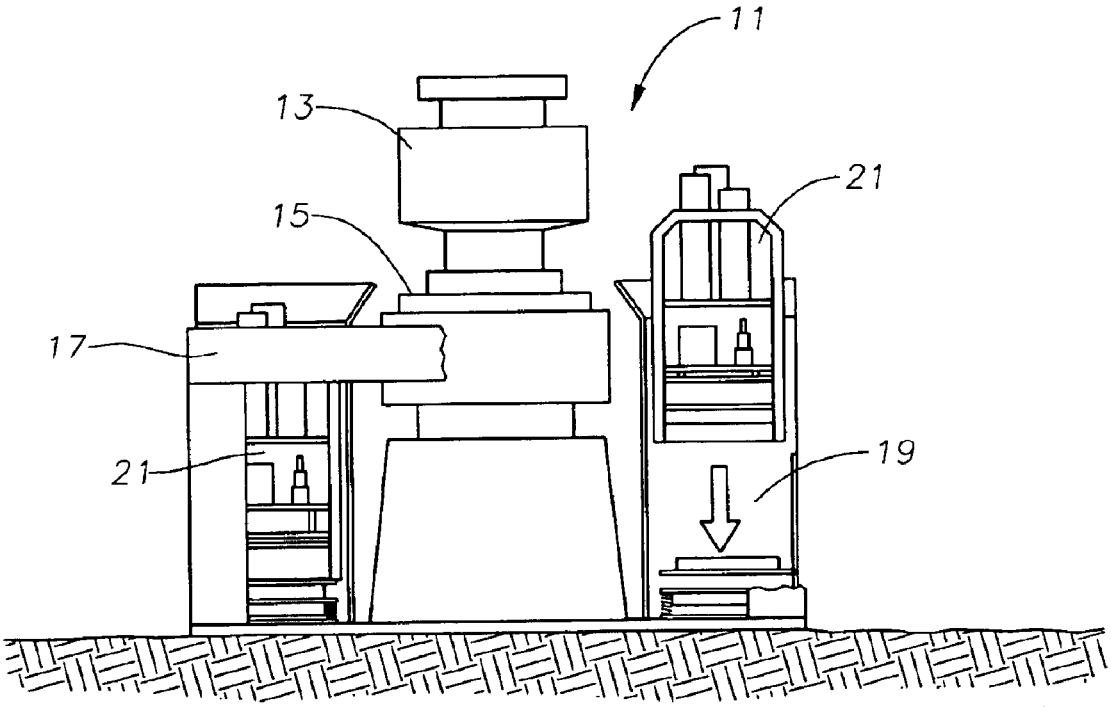
FIG. 1C is a partial sectional view of the well assembly and control pod of FIG. 1A, wherein the control pod is aligned with the guideframe of FIG. 1B for landing in the well assembly.
Figure 1D:
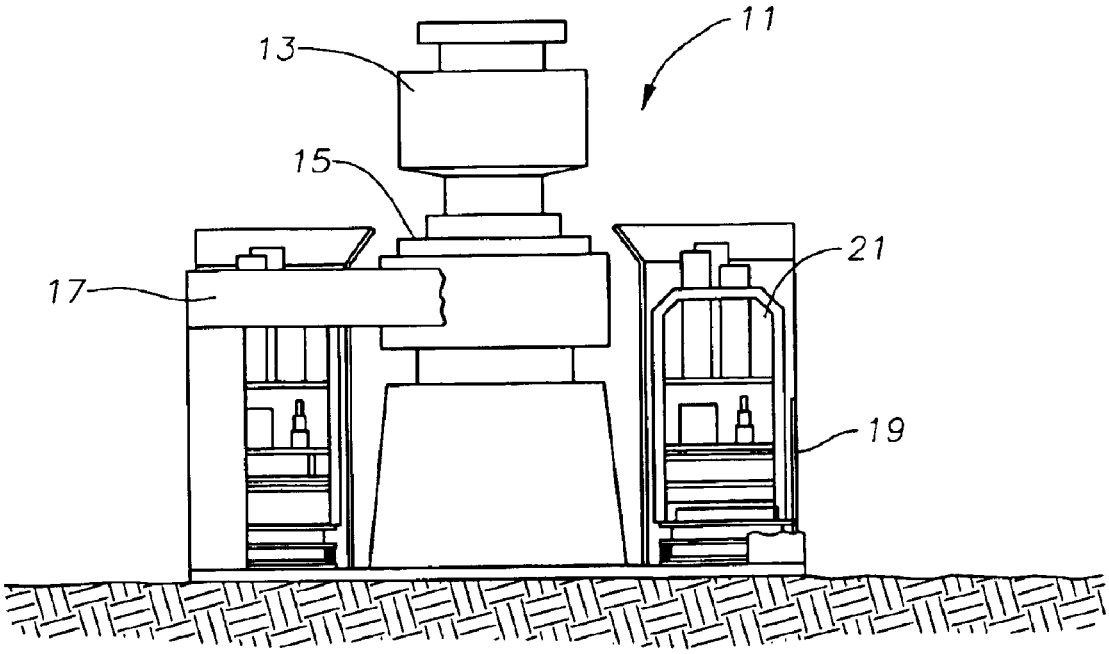
FIG. 1D is a partial section view of the well assembly and the control pod of FIG. 1D wherein the control pod has landed in the guideframe of FIG. 1B.

As shown in FIG. 1A, control pod 21 is lowered to guideframe 19. Typically, control pod 21 is lowered with a cable or support line 39 (FIG. 3) from a vessel at the surface. Control pod 21 is lowered until control pod 21 is adjacent frame 17, but above control pod guideframe 19. As shown in FIG. 1B, control pod 21 is maneuvered toward control pod guideframe 19 after control pod 21 is adjacent frame 17 and above control pod guideframe 19. Control pod 21 is maneuvered toward control pod guideframe 19 until control pod 21 is directly above control pod guideframe 19 and within main frame 17 to the position shown in FIG. 1C. Typically, a remote operated vehicle (ROV) pushes or maneuvers control pod 21 from the position shown in FIG. 1B to the position shown in FIG. 1C, however, the same maneuver could also be accomplished by maneuvering control pod 21 with support line 39 (FIG. 3) from the vessel above. Control pod 21 is then lowered into guideframe 21 from the position shown in FIG. 1C to the position shown in FIG. 1D.

Figure 2:
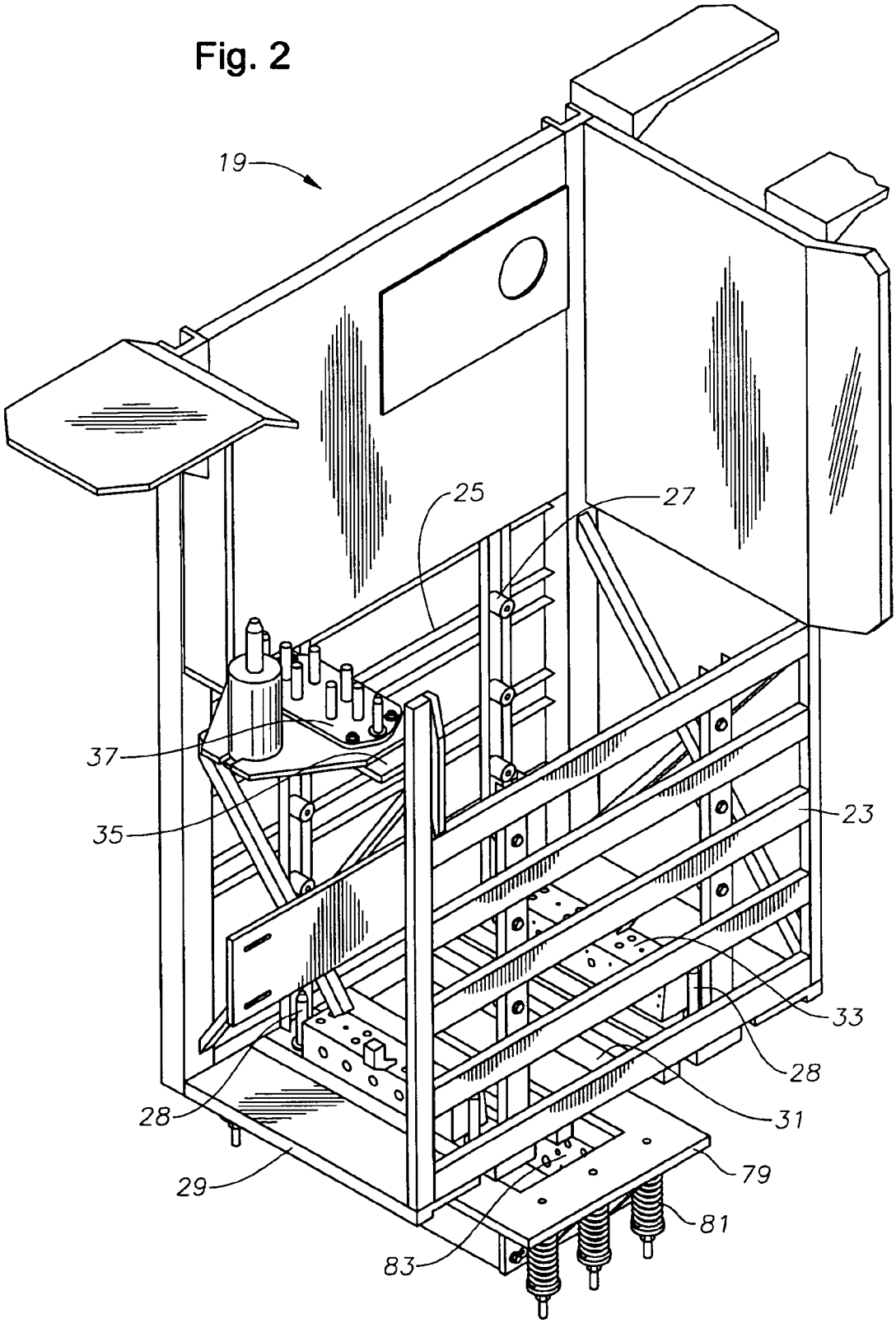
FIG. 2 is an enlarged perspective view of the guideframe of FIG. 1B.

Referring to FIG. 2, in the preferred embodiment, control pod guideframe, or guideframe 19 has a front side 23 and a rear side 25. Front side 23 is shorter than rear side 25, which allows control pod 21 to enter guideframe 19 from the side before being lowered into guideframe 19. Typically, control pod 21 abuts rear side 25 after being maneuvered from FIG. 1B to 1C. Abutting rear side 25 can help the operator know that control pod 21 is properly aligned for being lowered into guideframe 19 to the position shown in FIG. 1D. In the preferred embodiment, guideframe 19 includes guide rollers 27 that are intermittently spaced in vertical rows to help guide control pod 21 into guideframe 19. In the preferred embodiment, guide rollers 27 are positioned in two vertical rows on front side 23, and two vertical rows on rear side 25.

A lower plate 29 preferably forms the lower end of guideframe 19. A plurality of guide pins 28 extend generally upward from lower plate 29 to engage and further align control pod 21 as it lands in guideframe 19. Control pod 21 lands on lower plate 29 when in the position shown in FIG. 1D. An opening is formed in lower plate 29. In the preferred embodiment, opening 31 is formed toward a middle portion of lower plate 29, extending from front side 23 to rear side 25. An upper control panel 33 is positioned on lower plate 29, adjacent opening 31. In the preferred embodiment, there are two control panels 33, positioned adjacent opening 31. Typically, control panels 33 are in hydraulic communication with either BOP 13 or LMRP 15, or both. In the preferred embodiment, control panels 33 communicate with BOP 13. In the preferred embodiment, a support 35 is positioned on guideframe 19 above lower plate 29, and between front and rear sides 23, 25. Typically, support 35 is at an elevation that is farther from lower plate 29 than the uppermost portion of front side 23. An upper stab plate assembly 37 is located on support 35. Upper stab plate assembly 37 is typically in electrical communication with either BOP 13 or LMRP 15, or both. In the preferred embodiment, upper stab plate assembly 37 communicates with BOP 13. Preferably upper stab plate assembly 37 is oriented upwardly so that it connects with a portion of control pod 21 when control pod 21 is lowered into guideframe 19.

Figure 3:
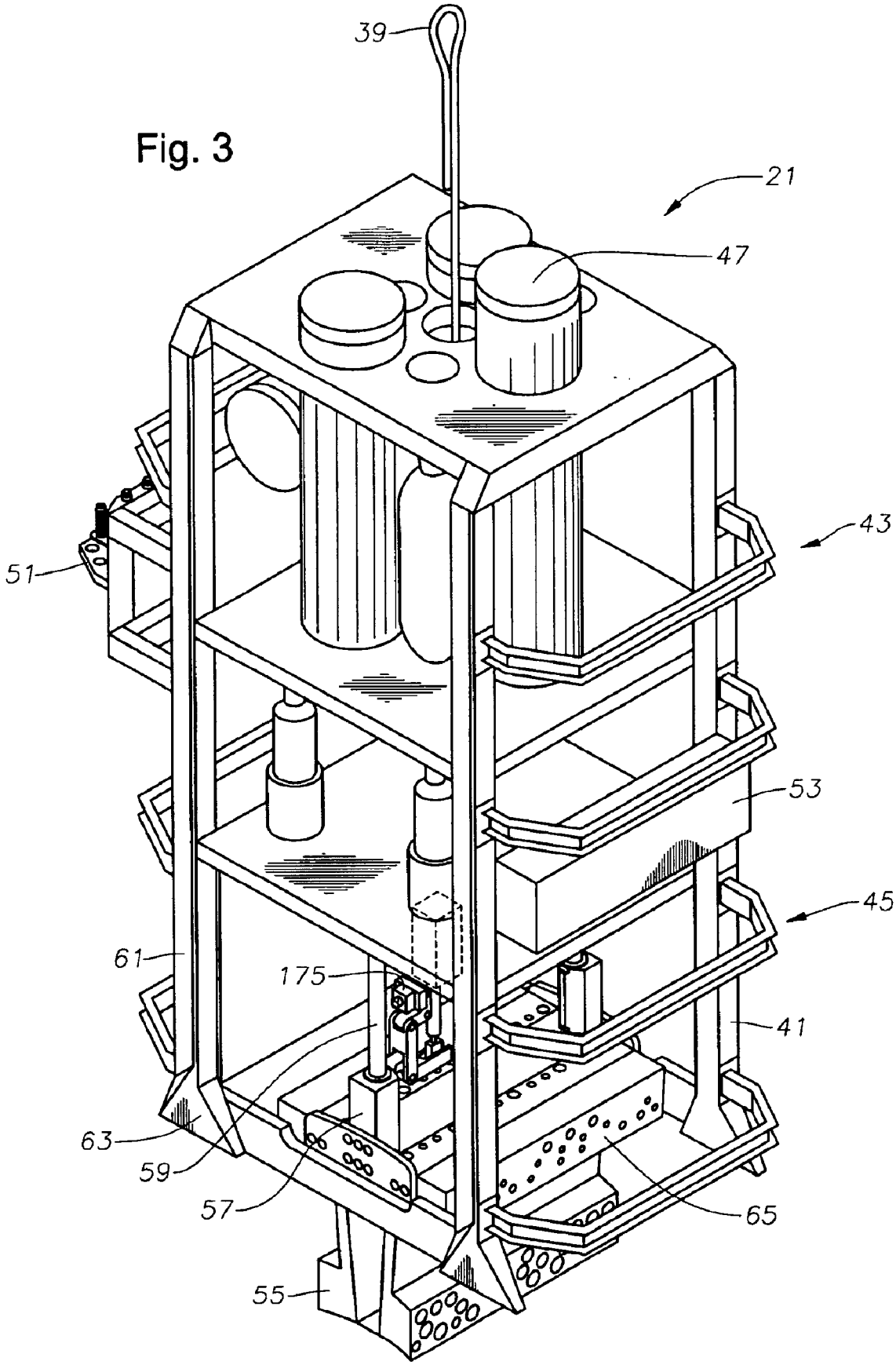
FIG. 3 is an enlarged perspective view of the control pod of FIG. 1A.

Referring to FIG. 3, support line 39 extends from an upper end of control pod 21 for lowering and supporting control pod 21 from a vessel. In the preferred embodiment, a control pod frame 41 forms the outer portions of control pod 21. Preferably, control pod 21 has an upper portion 43 and a lower portion 45. Upper portion 43 typically houses an electrical source 47, and can house or be in communication with a hydraulic source (not shown), and is in communication with the vessel. In the preferred embodiment, electrical source 47 is removable from control pod 21 by lifting electrical source 47 from upper portion 43. Typically, electrical source 47 is only removed and installed while control pod 21 is on the vessel at the surface. In the preferred embodiment, a upper stab mechanism assembly 51 is also positioned on upper portion 43. Typically, upper stab assembly 51 protrudes from a side of control pod 21 and aligns with upper stab plate assembly 37 (FIG. 2) when pod 21 is in the positions shown in FIGS. 1C and 1D.

In the preferred embodiment, valves 53 are located in lower portion 45. Valves 53 control hydraulic fluid that is used from controlling the functions of BOP 13 and LMRP 15. In the preferred embodiment, valves 53 are in fluid communication with upper portion 43 and can be actuated remotely from the vessel or by an ROV. In the preferred embodiment, a stab assembly 55 is located in lower portion 45. Preferably, stab assembly 55 is selectively movable relative to pod frame 41 between an upper position shown in FIG. 4A, and a lowered position shown in FIG. 4D. Preferably, stab assembly 55 extends between two sides of control pod 21. Referring back to FIG. 3, stab assembly 55 preferably includes a stab post 57 extending in a generally upwardly direction. Stab assembly 55 is in fluid communication with upper portion 43. In the preferred embodiment, stab assembly 55 is in both hydraulic and electrical communication with upper portion 43. Typically, there are at least two stab posts 57 located on opposite ends of stab assembly 55. In the preferred embodiment, a piston 59 extends between each stab post 57 and a portion of control pod 21 above stab assembly 55. Piston 59 is preferably hydraulically actuated to move stab assembly 55 from its upper position to its lower position.

In the preferred embodiment, pod frame 41 includes a plurality of guide rails 61. Guide rails 61 are located on opposite sides of control pod 21 and extend vertically from a lower end of frame 41 to the upper portion 43 of control pod 21. Guide rails 61 slidingly receive guide rollers 27 (FIG. 2) as control pod 21 moves between the position in FIG. 1C to the position in FIG. 1D, which properly aligns control pod 21 within guideframe 19. In the preferred embodiment, a flared portion 63 is located toward the lower end of each guide rail 61. Flared portions 63 are wider than the upper portion of guide rails 61 to aid guide rails 61 in receiving guide rollers 27 as control pod 21 lowers into pod guideframe 19.

In the preferred embodiment, a connector panel 67 is also located in lower portion 45 of control pod 21. There are preferably two connector panels 67 located toward a lower end of control pod 21 so that connector panels 67 engage upper control panels 33 on lower plate 29 (FIG. 2). As best illustrated in FIG. 4A–4D, connector panels 67 are preferably located adjacent opposite sides of stab assembly 55, and located to engage a surface of each upper control panel 33 (FIG. 2) closest to opening 31. FIGS. 4A–4D collectively illustrate connecting control pod 21 to register with BOP 13 and LMRP 15 through landing control pod 21 from the position shown in FIGS. 1C and 4A to the position shown in FIGS. 1D and 4B, and lowering stab assembly 55 from its upper position to its lower position.

Figure 4A:
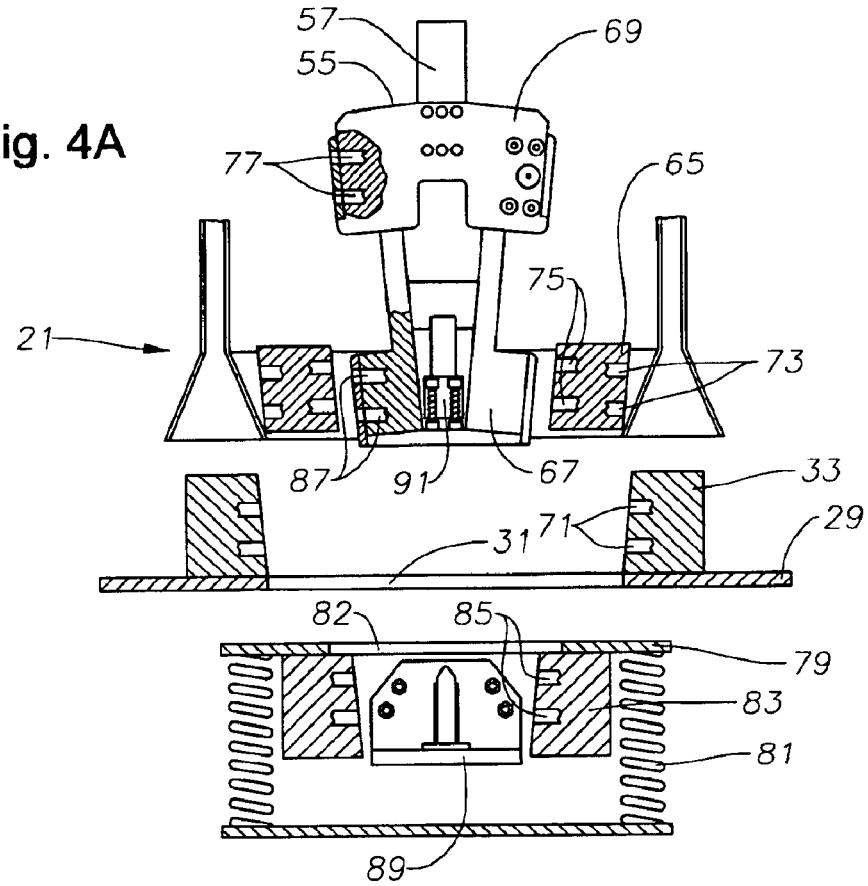
FIG. 4A is a cross-section view of the control pod and guideframe of FIGS. 1A–1D as the control pod is landing in the guideframe.
Figure 4B:
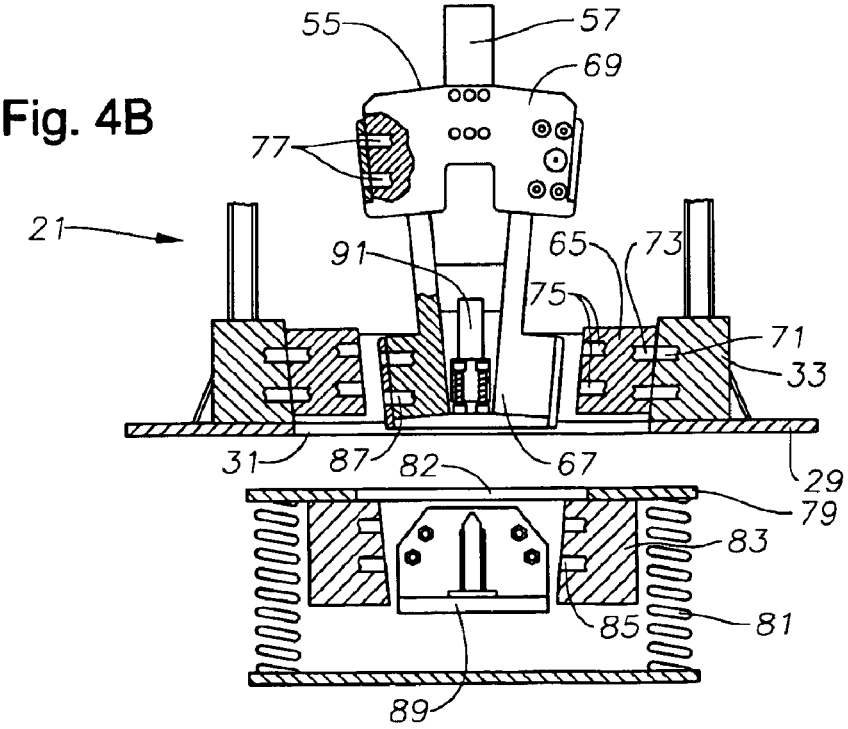
FIG. 4B is a cross-section view of the control pod and guideframe of FIGS. 1A–1D after the control pod lands in the guideframe, wherein a stab assembly is shown in an upper position.

Referring to FIG. 4A, a portion of control pod 21 approaches control panels 33 on lower plate 29 while control pod 21 is lowered into guideframe 19. In the preferred embodiment, stab assembly 55 is in the upper position as shown in FIG. 4A while control pod 21 approaches lower plate 29. Stab assembly 55 includes a lower portion 67 and an upper portion 69. In the preferred embodiment, both lower and upper portions 67, 69 of stab assembly 55 communicate with upper portion 43 (FIG. 3) of control pod 21. In the preferred embodiment, a plurality of upper panel ports or communication ports 71 are located on each control panel 33 on the side that is adjacent opening 31. Communication ports 71 are preferably in fluid communication with BOP 13. Preferably, the side of each control panel 33 having ports 71 is inclined so that the lower portion of each control panel 33 is narrower than the upper portion. In the preferred embodiment, each side of connector panel 65 that engages one of control panels 33 is inclined so that connector panel matingly engages control panel 33 when control pod 21 lands on lower plate 29, as shown in FIG. 4B. In the preferred embodiment, a plurality of outer connector ports or communication ports 73 are located on the side of each connector panel 65 that engages control panels 33. Outer connector communication ports 73 align and register with upper control panel communication ports 71 when control pod 21 lands on lower plate 29 in the position shown in FIG. 4B. Typically, the mating engagement between connector panel 65 and control panel 33 seals the interface between ports 71, 73. As will be readily appreciated by those skilled in the art, seals could also be used at the interface of ports 71, 73.

In the preferred embodiment, an inner surface of each connector panel 65, or the surface opposite from the surface engaging control panel 33, is inclined so that the width between each connector panel is larger between the lower portions of connector panels 65 than between the upper portions of connector panels 65. The inclinations of the opposite sides of connector panels 65 are substantially parallel, so that each connector panel 67 has substantially a parallelogram cross-section. A plurality of inner connector panel ports or communication ports 75 are located on the inclined surface of each connector panel 67 that is opposite from the surface having outer connector panel ports 73. In the preferred embodiment, inner ports 75 communicate through connector panel 65 with outer ports 73.

In the preferred embodiment, a plurality of upper stab assembly ports 77 are located on opposite sides of upper portion 69 of stab assembly 55. The opposite sides of upper portion 69 are inclined to matingly engage the inner surfaces of connector panels 65 that have communication ports 75 thereon. In the preferred embodiment, lower portion 67 of stab assembly 55 is narrower than the space between connector panels 65 so that lower portion 67 can pass between connector panels 67 as stab assembly 55 moves to the upper position shown in FIG. 4A to the lower position shown in FIG. 4D. As shown in FIG. 4D, upper stab assembly ports 77 register with inner connector panel ports 75 when stab assembly 55 is in the lower position. Upper stab assembly communication ports 77 are in fluid communication with upper portion 43 of control pod 21. Upper portion 43 of control pod 21 is in fluid communication with BOP 13 through ports 77, 75, 73, 71 when stab assembly 55 is in the lower position shown in FIG. 4D. In the preferred embodiment, upper portion 43 of control pod 21 is in hydraulic communication with BOP 13 through upper portion 69 of stab assembly 55, connector panel 65, and control panel 33.

In the preferred embodiment, a lower support 79 (FIG. 4A) is located below lower plate 29 of guideframe 19. A plurality of springs 81 hold lower support 79 above a lower surface. In the preferred embodiment, lower support 79 has an opening 82 centrally located between springs 81 that is wide enough for lower portion 67 of stab assembly 55 to pass through. At least one lower control panel 83 is supported by lower support 79. In the preferred embodiment, there are two lower control panels 83 located adjacent opposite sides of opening 82, with control panels 83 connecting to an underside of lower support 79. Each control panel 83 has an inner side that is inclined and forms a portion of opening 82, so that opening 82 is wider toward lower plate 29 than toward the lower ends of control panels 83. The width of opening 82 between the lower ends of control panels 83 is narrower than lower portion 67 of stab assembly 55.

A plurality of lower control panel communication ports 85 are located on the inner, inclined surfaces of each control panel 83 that defines a portion of opening 82. Communication ports 85 are in fluid communication with LMRP 15. In the preferred embodiment, communication ports 85 are in hydraulic communication with LMRP 15. A plurality of stab assembly lower communication ports 87 are located on opposite sides of stab assembly 55 on lower portion 69 for registering with lower control panel ports 85. Communication ports 87 are in fluid communication with upper portion 43 (FIG. 3) of control pod 21. In the preferred embodiment, communication ports 87 are in hydraulic communication with upper portion 43. After control pod 21 lands on stab plate 29 (FIG. 4B), piston 59 (FIG. 3) moves stab assembly 55 from its upper position to an intermediate position shown in FIG. 4C. In the preferred embodiment, the stab assembly 55 is between the upper and lower positions shown in FIGS. 4A, 4D while in the intermediate position shown in FIG. 4C. Lower portion 67 engages control panels 83 and communication ports 85, 87 register with each other when stab assembly 55 is in its intermediate position shown in FIG. 4C. Upon moving stab assembly 55 to the intermediate position, stab assembly lower communication ports 87 register with lower control panel communication ports 85 so that upper portion 43 (FIG. 3) of control pod 21 is in fluid communication with LMRP 15.

In the preferred embodiment, a lower stab plate assembly 89 is supported by lower support 79. Lower stab plate assembly 89 preferably hangs below the upper portion of lower support 79 and is positioned between control panels 83. In the preferred embodiment, lower stab plate assembly is in electrical communication with LMRP 15. Stab assembly 55 preferably includes a lower electrical stab mechanism assembly 91 in lower portion 67 toward the lower end of stab assembly 55. Lower electrical stab mechanism assembly 91 is preferably in electrical communication with electric source 47 in upper portion 43 (FIG. 3) of control pod 21. In the preferred embodiment, lower stab plate assembly 89 engages lower electrical stab mechanism assembly 91 and receives a portion of lower electrical stab mechanism assembly 91 when stab assembly moves from the position shown in FIG. 4B to the intermediate position shown in FIG. 4C. LMRP 15 is in electrical communication with upper portion 43 (FIG. 3) when stab assembly 55 is in the intermediate position.

Figure 4C:
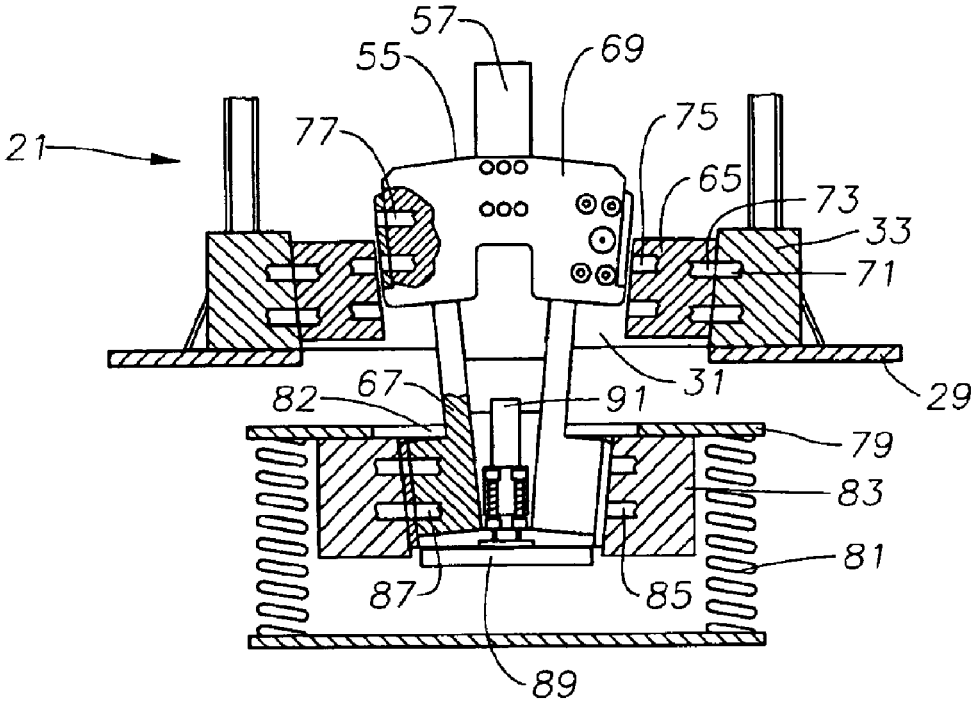
FIG. 4C is a cross-section view of the control pod and guideframe of FIGS. 1A–1D, wherein the stab assembly of FIG. 4C is shown in an intermediate position.
Figure 4D:
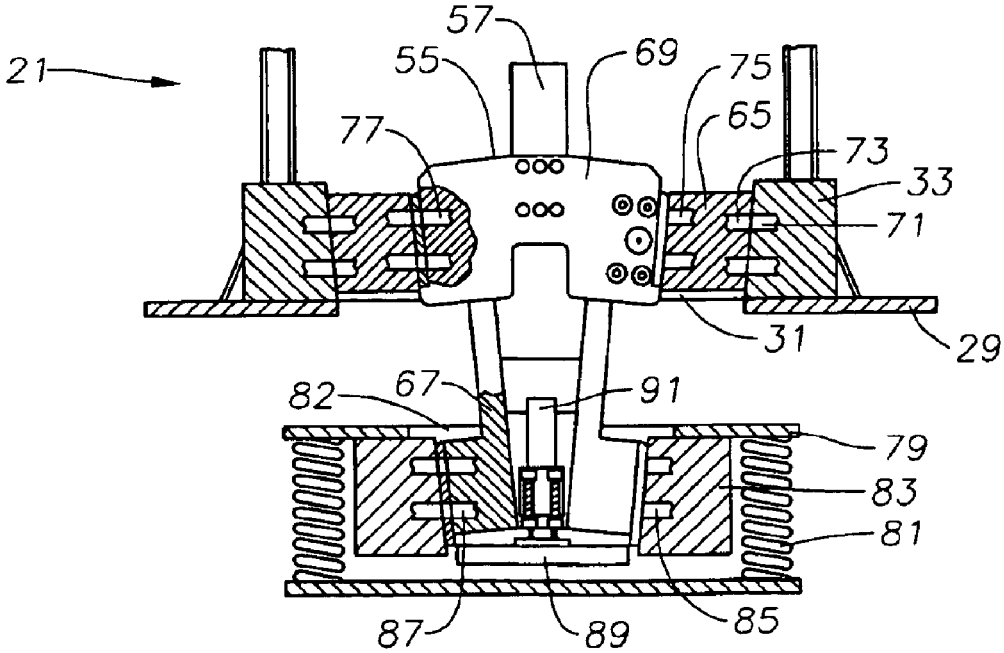
FIG. 4D is a cross-section view of the control pod and guideframe of FIGS. 1A–1D, wherein the stab assembly of FIG. 4D is shown in a lower position.

As shown in FIG. 4C, stab assembly upper ports 77 and inner connector ports 75 do not register with each other while stab assembly 55 is in the intermediate position. Piston 59 continues to push stab assembly from the intermediate position in FIG. 4C to the lower position in FIG. 4D. Lower portion 67 is wider than opening 82 between the lowermost portions of lower control panels 83. Therefore, piston 59 engages lower control panels 83 when moving stab assembly 55 from the intermediate position in FIG. 4C to the lower position in FIG. 4D. Pushing down on control panels 83 causes springs 81 to compress, thereby allowing lowering lower support 79, control panels 83, and lower stab plate assembly 89 to move with stab assembly 55. Piston 59 pushes stab assembly 55 until upper portion 69 of stab assembly 55 matingly engages connector panels 75 as shown in FIG. 4D. When stab assembly 55 is in the lower position as shown in FIG. 4D, stab assembly upper ports 77 register with inner connector ports 75, therefore allowing communication from upper portion 43 (FIG. 3) of control pod with both BOP 13 and LMRP 15 through stab assembly 55.

Figure 5:
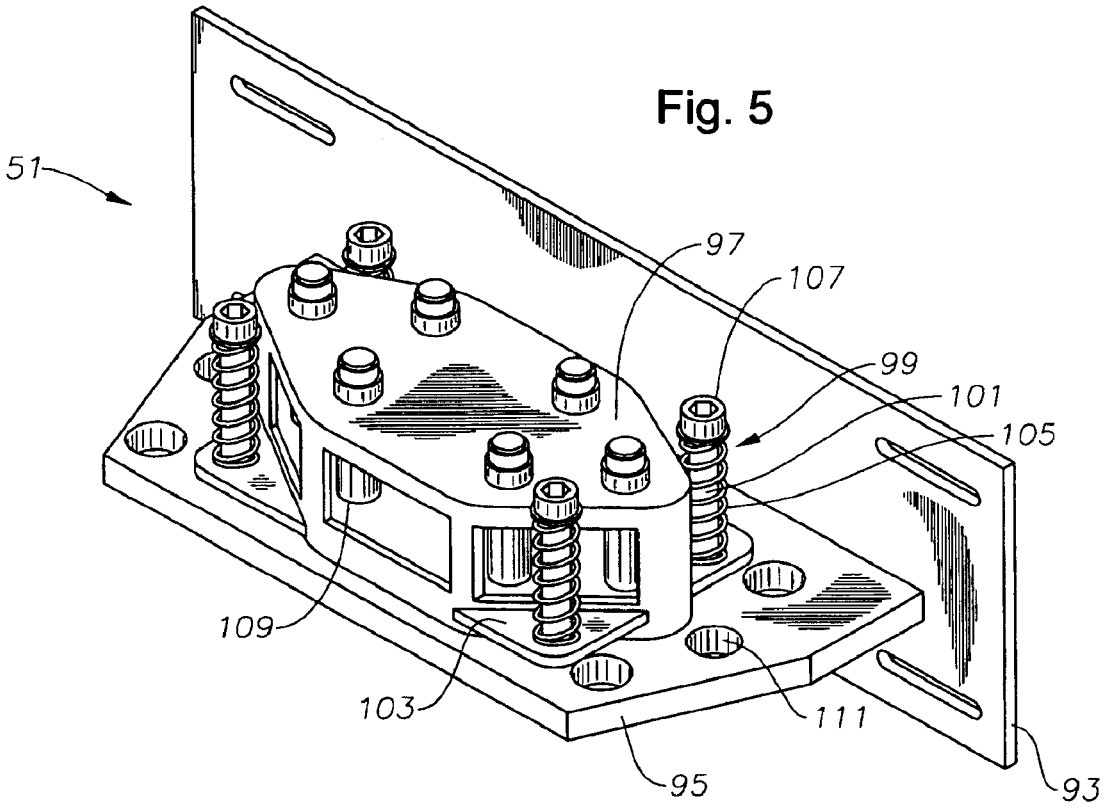
FIG. 5 is a perspective view of an upper electric stab mechanism assembly that is shown attached to the control pod in FIG. 3.
Figure 7:
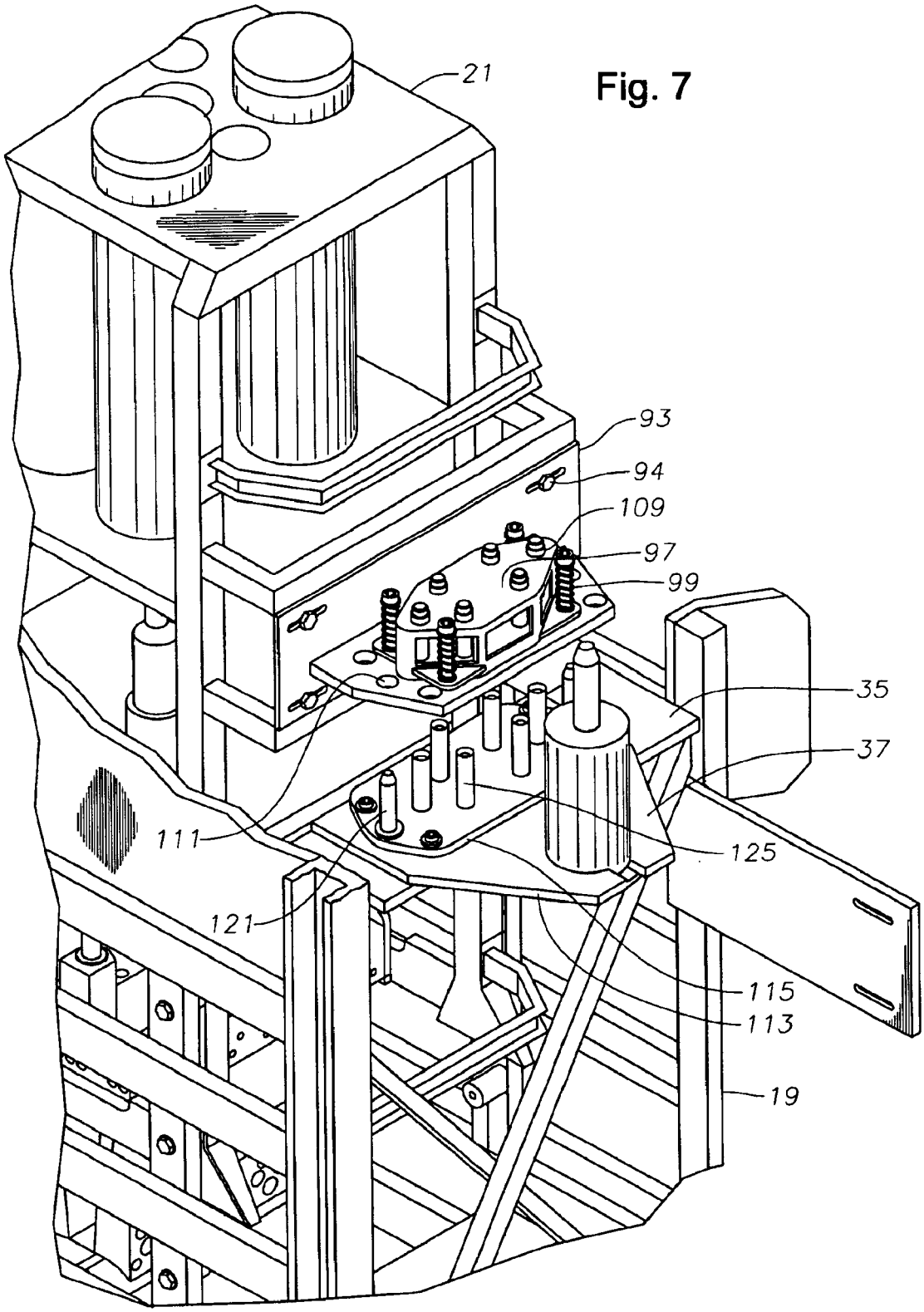
FIG. 7 is a perspective view of the upper electric stab mechanism assembly of FIG. 5 and the upper electric stab plate assembly of FIG. 6 while the control pod lands in the guideframe as shown in FIG. 1C.

Referring to FIG. 5, upper stab assembly 51 (also shown in FIG. 3) preferably includes a mounting plate 93, and a support plate 95. Mounting plate 93 typically connects to control pod 21 (FIG. 3) with threaded fasteners 94 (FIG. 7). In the preferred embodiment, support plate 95 extends from mounting plate 93 generally away from one of the sides of control pod 21. In the preferred embodiment, a stab assembly frame 97 is attached to support plate 95. At least one spring rod 99 connects stab assembly frame 97 to support plate 95. In the preferred embodiment, there are a plurality of spring rods 99 connecting stab assembly frame 97 to the upper side of support plate 95. However, one skilled in the art will readily appreciate that stab assembly frame 97 could also be attached to the underside of support plate 95 with spring rods 99.

In the preferred embodiment, each spring rod 99 includes a threaded fastener or bolt 101 that passes through an opening formed in a plate portion or frame plate 103 of stab assembly frame 97 and threadedly engages support plate 95. Typically bolt 101 includes a bolt head 105 that is larger in diameter than the threaded portion of bolt 101. Each spring rod 99 preferably also includes a spring 107 that is positioned between frame plate 103 and bolt head 105. Springs 107 engage frame plate 103 and bolt head 105 so that stab assembly frame 97 is allowed to move vertically relative to support plate 95 when a predetermined upward force pushes on stab assembly frame 97. Upper stab assembly 51 also includes an electrical stab 109 that extends generally downward from stab assembly frame 97 and is in electrical communication through cables or wires (not shown) to electric source 47 (FIG. 3). In the preferred embodiment, there are a plurality of electrical stabs 109 that are each in communication with electric source 47, and are spaced intermittently on stab assembly frame 97. Upper stab assembly 51 includes a pair of guide openings 111 extending through support plate 95 for aligning upper stab plate assembly 37 (FIGS. 2, 6) with stab assembly 51.

Figure 6:
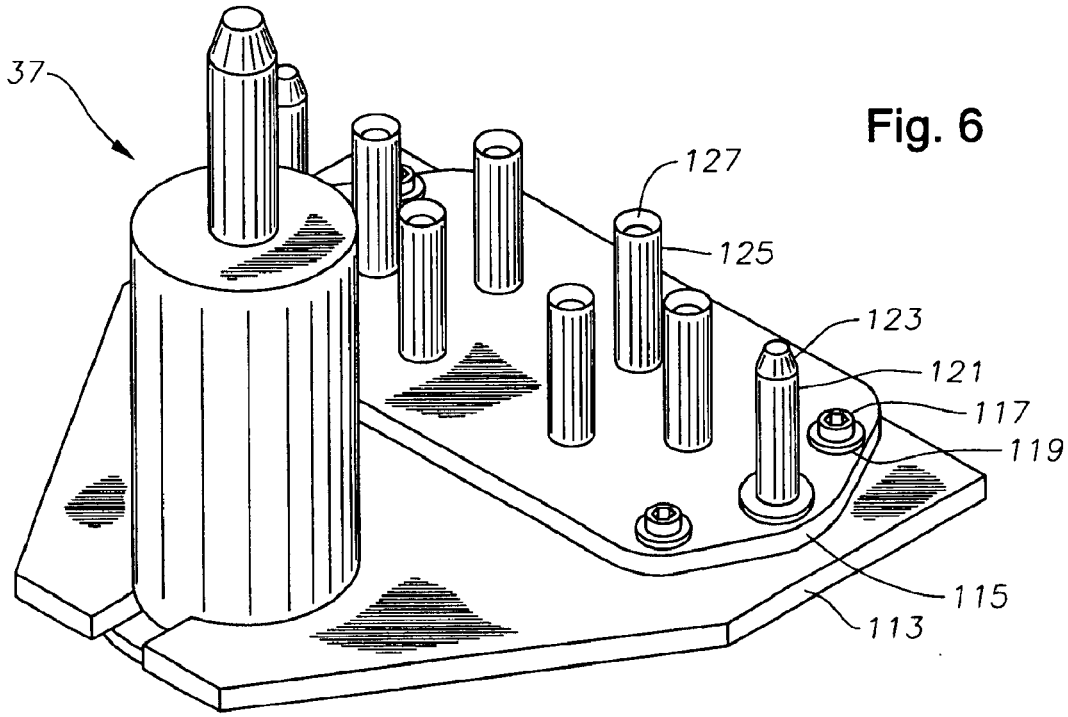
FIG. 6 is perspective view of an upper electric stab plate assembly that is shown attached to the guideframe in FIG. 2.
Figure 8:
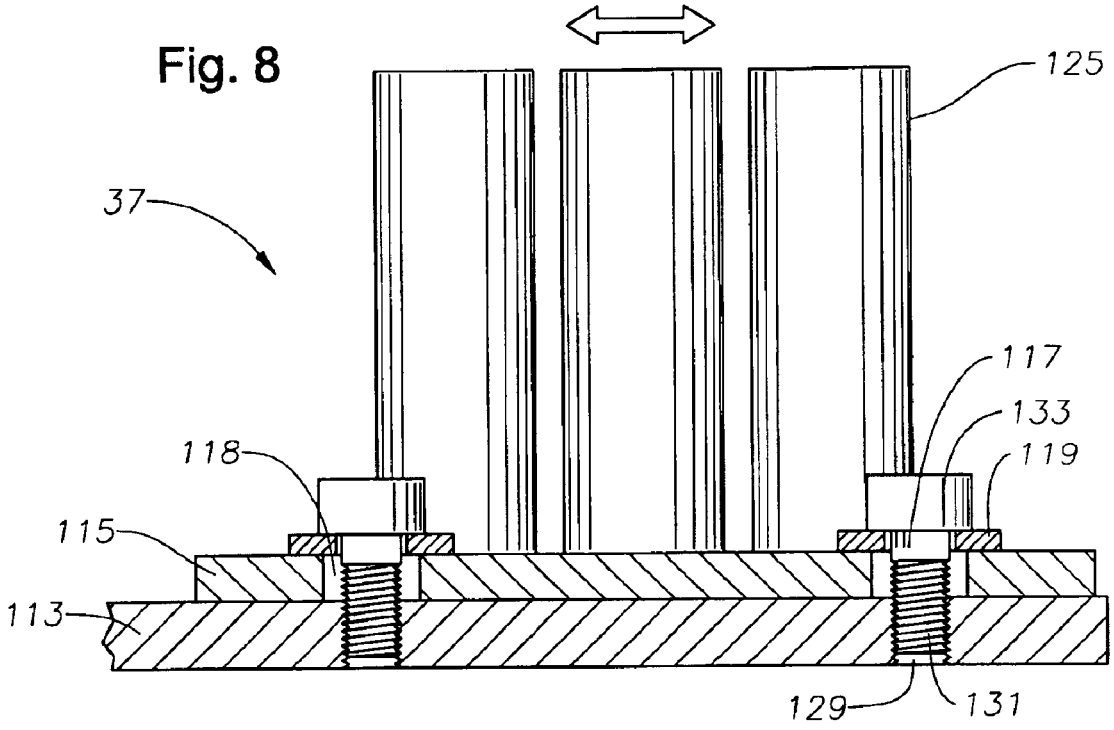
FIG. 8 is a cross-section view of the upper electric stab plate assembly shown in FIG. 6.

Referring to FIG. 6, upper stab plate assembly 37 preferably includes a support plate or base plate 113 that is connected to a portion of guideframe 19 (FIG. 2), and as shown in FIG. 2 is located outside of the portion of guideframe 19 that receives control pod 21 (FIG. 3). A compliance plate or stab plate 115 slidingly engages the upper surface base plate 113. Each of a plurality of threaded fasteners or bolts 117 extends through a plurality of openings 118 (FIG. 8) extending from an upper side to a lower side of stab plate 115. As shown in FIG. 8, in the preferred embodiment, opening 118 is larger than the diameter of a portion of bolt 117 extending therethrough, which allows stab plate 115 to slide along base plate 113 a predetermined distance that is equal to the difference in diameters of bolt 117 and opening 118. Referring again to FIG. 6, in the preferred embodiment, there is a washer 119 between each bolt 117 and stab plate 115. Washers 119 allow stab plate 115 to slide more easily relative to bolts 117.

A pair of guideposts 121 are preferably connected to the upper surface of stab plate 115 for aligning stab plate assembly 37 with stab assembly 51. Guideposts 121 stab through guide openings 111 (FIG. 5). Referring to FIG. 7, a portion of guideframe 19 is shown receiving control pod 21 that is being lowered from the position shown in FIG. 1C to the landed position shown in FIG. 1D. In the preferred embodiment, the alignment of control pod 21 relative to guideframe 19 with rollers 27 and rails 61 aligns guideposts 121 within a predetermined tolerance with guide openings 111. Upper stab plate assembly 37 however is capable of sliding relative to support plate 113 so that stab plate assembly 37 self-aligns with stab assembly 51 for proper engagement with electrical stabs 109. Referring back to FIG. 6, each guidepost 121 has a conical end 123, which is the portion of guideposts 121 that is received first by guide openings 111. As conical end 123 slidingly engages openings 111, conical end 123 causes stab plate 115 to slide relative to support plate 113 until the portion of each guidepost 123 below conical end 123 is aligned to slide through opening 111.

At least one, and preferably a plurality of receptors 125 (FIG. 7) extend generally upward from stab plate 115 and are intermittently spaced to align with electrical stabs 109 (FIG. 6). Each receptor 125 is preferably a tubular member that receives a portion of each respective electrical stab 109. In the preferred embodiment, each receptor 125 is in electrical communication through wires or cables (not shown), in a manner known in the art, with BOP 13. Therefore, BOP 13 is in electrical communication with electric source 47 (FIG. 3) on control pod 21 when receptors 125 receive electrical stabs 109. A receptor opening 127 is located toward the end of each receptor 125 that receives electrical stabs 109. Receptor opening 127 is funnel-shaped to guide electrical stab 109 into the center of each tubular receptor 125.

Referring to FIG. 8, a cross-section of upper stab plate assembly 37 illustrates the capacity for stab plate 115 to move relative to base plate 113. In the preferred embodiment, a plurality of threaded bores 129 are formed in base plate 113 for receiving bolts 117. Threaded bore 129 defines a first bore diameter. In the preferred embodiment, bolt 117, which extends through washer 119, stab plate 115, and base plate 113, includes a threaded portion 131 and a bolt head portion 133. Threaded portion 131 has substantially the same diameter as bore 129, and first bore diameter, so that the threads on threaded portion 131 engage threaded bore 129 to hold bolt 117 relative to base plate 113. Bolt head portion 133 is larger than the first bore diameter. Opening 118 defines a first opening diameter that is larger than first bore diameter so that stab plate 115 can slidingly engage base plate 113 a distance substantially equal to the difference between the first bore diameter and the first opening diameter. In the preferred embodiment, washer 119 has an inner circumference that is large enough to receive threaded portion 131 of bolt 117, and an outer circumference that is large enough to cover opening 118 and overlap onto a portion of stab plate 115 while stab plate 115 slides. In the preferred embodiment, the inner circumference of washer 119 is too small to receive bolt head portion 133. Therefore, bolt head portion 133, washer 119, and threaded portion 131 hold stab plate 115 vertically relative to base plate 113 while allowing stab plate 115 to slide horizontally relative to base plate 113.

Figure 9:
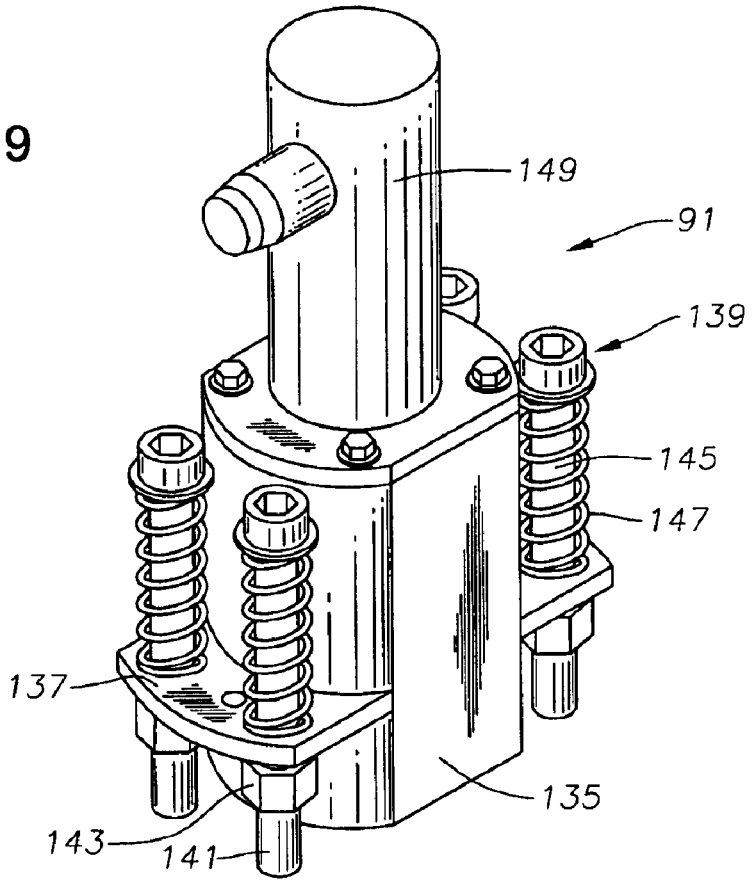
FIG. 9 is a perspective view of a lower electric stab mechanism assembly that is located on the stab assembly shown in FIGS. 4A–4D.

Referring to FIG. 9, lower electrical stab mechanism assembly 91 (also shown in FIG. 4A) is shown apart from stab assembly 55. In the preferred embodiment, stab assembly 91 includes a casing 135 that comprises the main body of lower stab assembly 91. Stab assembly 91 preferably also includes a casing plate 137 extending radially outward from casing 135 and is located toward the lower portion of stab assembly 91. Stab assembly 91 also includes a plurality of spring rods 139 connected to casing plate 137, and positioned intermittently around the outer circumference of casing 135. Like spring rods 99 on upper electrical stab assembly 51, each spring rod 139 includes a bolt 141 that connects spring rod 99 to casing plate 137. Bolt 141 extends below casing 135 and connects lower electrical stab mechanism assembly 91 to a lower portion of stab assembly 55 as shown in FIGS. 4A–4D.

In the preferred embodiment, a nut 143 positioned on each bolt 141 engages the underside of casing plate 137 to hold casing 135 above the portion of stab assembly 55 that bolts 141 engage. Each bolt 141 preferably has a bolt head 145. Each spring rod 139 also includes a spring 147 that surrounds a portion of bolt 141 and is located between bolt head 145 and casing plate 137. Springs 147 engage bolt head 145 and casing plate 137 to allow for vertical compliance or vertical adjustments of stab assembly 91 upon connecting to lower stab plate assembly 89 (FIGS. 4A–4D, 10). Lower electrical stab mechanism assembly 91 preferably includes an electrical stab 149, having a portion encased by casing 135 and another portion extending above casing 135 connected to wires or cables (not shown) for communicating with electrical source 47 (FIG. 3). Lower electrical stab plate assembly 89 that is in electrical communication with LMRP 15 receives a portion of electrical stab 149 when stab assembly 55 is in the intermediate position shown in FIG. 4C and lower position shown in FIG. 4D.

Figure 10:
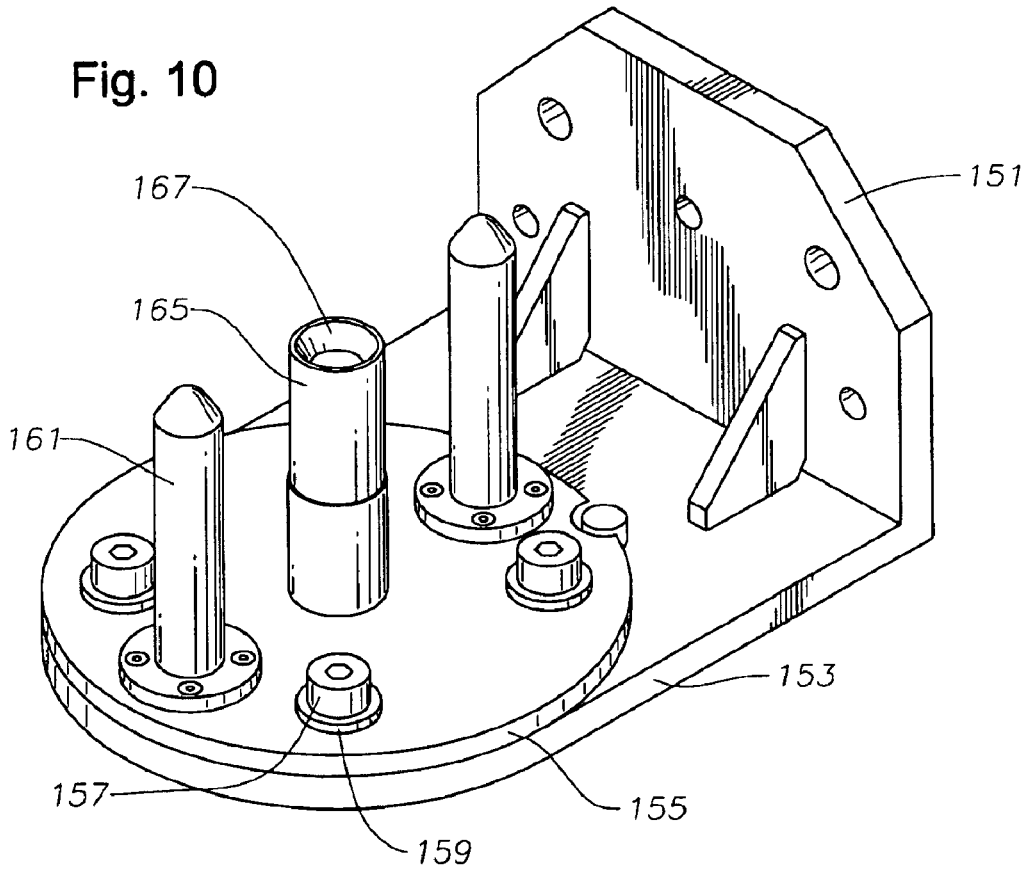
FIG. 10 is a perspective view of a lower electric stab plate assembly that is located below the stab assembly as shown in FIGS. 4A–4D.

Referring to FIG. 10, lower electrical stab plate assembly 89 is shown apart from lower support 79 (FIGS. 4A–4D). Lower stab plate assembly 89 includes a mounting plate 151 for connecting assembly 89 to lower support 79, preferably with threaded fasteners (not shown). A support plate 153 extends from mounting plate 151, and supports and aligns the portion of stab plate assembly 89 for connecting with lower electrical stab mechanism assembly 91 (FIG. 9). A compliance plate or stab plate 155 slidingly engages an upper surface of support plate 153. A threaded fastener or bolt 157 and a washer 159 engage stab plate 155 in a manner similar to upper stab plate assembly 37 so that stab plate 155 is held against support plate 153 while being able to slidingly engage support plate 153.

A pair of guideposts 161 extend generally upward from upper surface of stab plate 155, each guidepost 161 having a substantially conical end 163 for aligning stab plate 155 with lower stab assembly 91. Guideposts 161 do not slide into an opening like the engagement guideposts 121 (FIG. 6) and guide opening 111 (FIG. 5) on upper stab and upper stab plate assemblies 51, 37 respectively. Rather, guideposts 161 slidingly engage the outer surfaces of opposite sides of casing 135 (FIG. 9). In the preferred embodiment, guideposts 161 are spaced apart from each other so that casing 135 slidingly fits between guideposts 161. Conical portions 163, like conical portions 123 of guideposts 121, cause stab plate 155 to slidingly engage support plate 153 until casing 135 can fit between guideposts 161. A receptor 165 is connected to stab plate 135 between guideposts 161 for receiving electrical stab 149 (FIG. 9). In the preferred embodiment, receptor 165 is substantially an equal distance from each of guideposts 161. Receptor 165 is preferably a tubular member having a receptor opening 167 that is substantially funnel-shaped to help guide electrical stab 149 into receptor 165.

Figure 11:
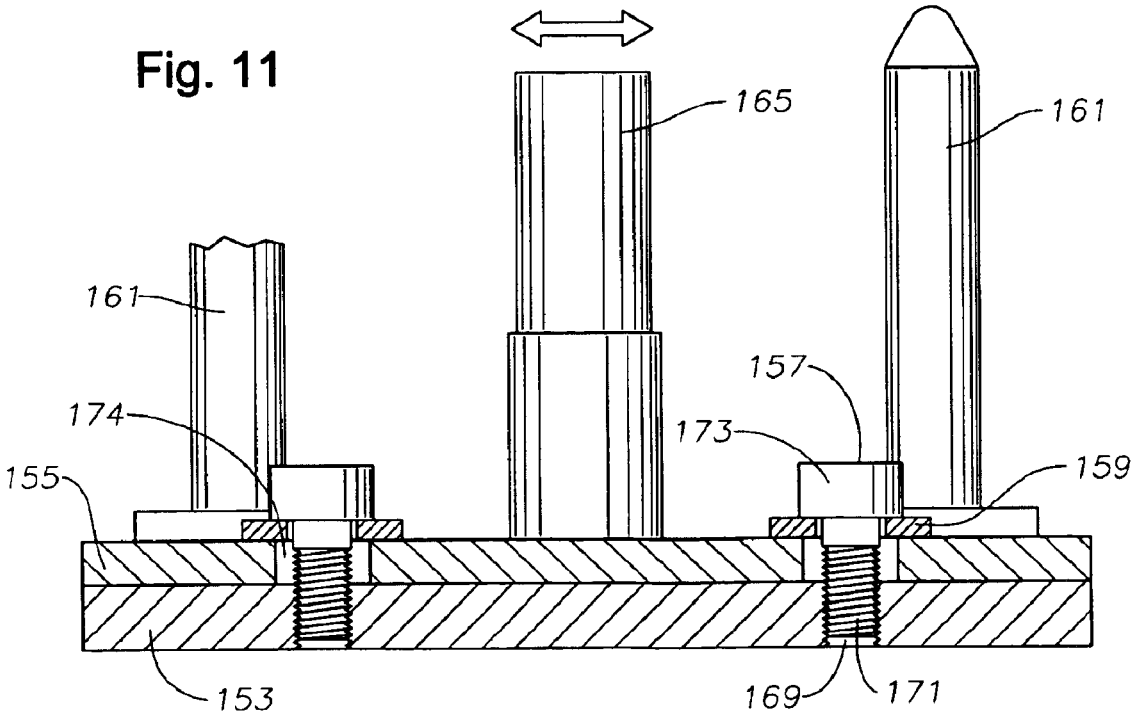
FIG. 11 is a cross-section view of the lower electric stab plate assembly shown in FIG. 10.

Referring to FIG. 11, stab plate 155 slidingly engages support plate 153 in a similar fashion as stab plate 115 slidingly engages base plate 113 in FIG. 7. A cross-section of lower stab plate assembly 89 illustrates how stab plate 155 moves relative to support plate 153. In the preferred embodiment, a plurality of threaded bores 169 are formed in support plate 153 for receiving bolts 157. Threaded bore 169 defines a second bore diameter, which in the preferred embodiment is substantially the same size as the first bore diameter. In the preferred embodiment, bolt 157, which extends through washer 159, stab plate 155, and support plate 153, includes a threaded portion 171 and a bolt head portion 173. Threaded portion 171 has substantially the same diameter as bore 169 and the second bore diameter, so that the threads on threaded portion 171 engage threaded bore 169 to hold bolt 157 relative to support plate 153. Bolt head portion 173 is larger than the second bore diameter.

Referring to FIG. 11, an opening 174 defines a second opening diameter that is larger than the second bore diameter. In the preferred embodiment, second opening diameter is substantially equally to first opening diameter in opening 118 (FIG. 7). Stab plate 159 can slidingly engage support plate 153 a distance substantially equal to the difference between the second bore diameter and the second opening diameter. In the preferred embodiment, washer 159 has an inner circumference that is larger enough to receive threaded portion 171 of bolt 157, and an outer circumference that is larger enough to cover opening 174 and overlap onto a portion of stab plate 155 while stab plate 155 slides. In the preferred embodiment, the inner circumference of washer 159 is too small to receive bolt head portion 173. Therefore, bolt head portion 173, washer 159, and threaded portion 171 hold stab plate 155 vertically relative to support plate 153 while allowing stab plate 155 to slide horizontally relative to support plate 153.

Figure 12:
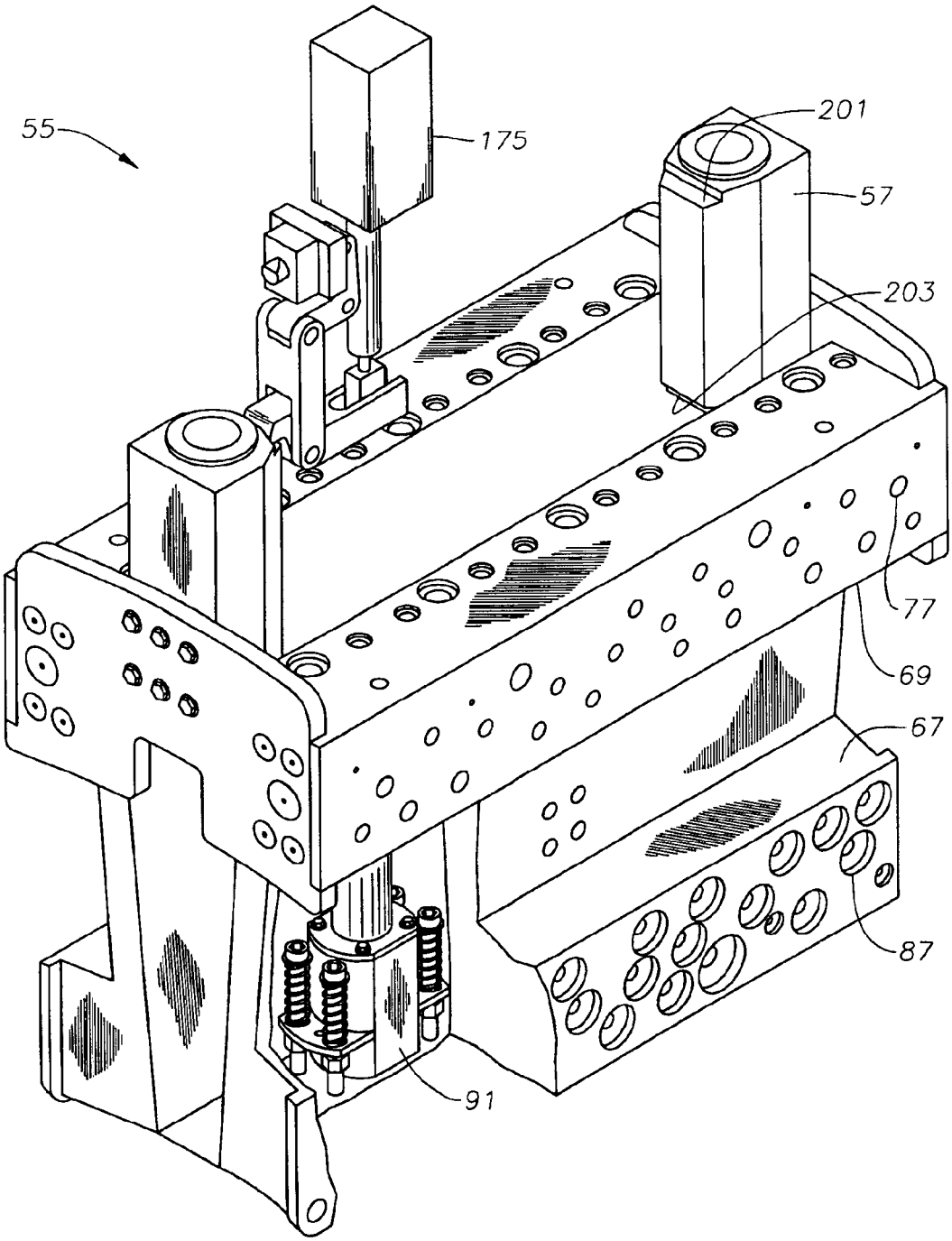
FIG. 12 is a perspective view of the stab assembly of FIGS. 4A–4D, with a cut-away portion showing the location of the lower electric stab assembly shown in FIG. 9.

Referring to FIG. 3, in the preferred embodiment, control pod 21 includes a lock mechanism assembly 175 that is located in lower portion 45 between pistons 59. Lock assembly 175 engages stab posts 57 to hold stab assembly either in its lower position shown in FIG. 3, 4D, or its upper position shown in FIG. 4A. Referring to FIG. 12, each stab post 57 preferably includes an upwardly facing upper shoulder 201 located toward the upper portion of stab post 57, and a lip or downwardly facing lower shoulder 203 located toward the lower portion of stab post 57. Lock assembly 175 (FIG. 3) selectively engages one of upper and lower shoulders 201, 203 to hold stab assembly 55 stationary, and disengages to allow stab assembly 55 to move between upper, lower, and intermediate positions.

As shown in FIG. 13B, lock mechanism assembly 175 preferably includes two locking means for engaging one of upper shoulder 201 or lower shoulder 203 (as shown by the dotted line representation). The first of the two locking means is a lock pin 177 that is positioned to engage lower shoulder 203 when stab assembly 55 and stab post 57 are in the upper position from FIG. 4A (represented by dotted lines in FIG. 13B). The second of the two locking means is a lock latch 179 that is located on lock assembly 175 to engage upper shoulder 201 when stab assembly 55 and stab post 57 are in the lower position from FIG. 4D. Preferably, lock pin 177 is integrally connected above lock latch 179 so that lock pin 177 and lock latch 179 are selectively actuated in unison. In the preferred embodiment, both lock pin 177 and lock latch 179 are selectively actuated between an unlocked position shown in FIG. 13A and a locked position shown in FIG. 13B. When lock mechanism assembly 175 is in the unlocked position shown in FIG. 13A, stab assembly 55 can be raised and lowered between its upper, intermediate, and lower positions illustrated in FIGS. 4A–4D.

Figure 14:
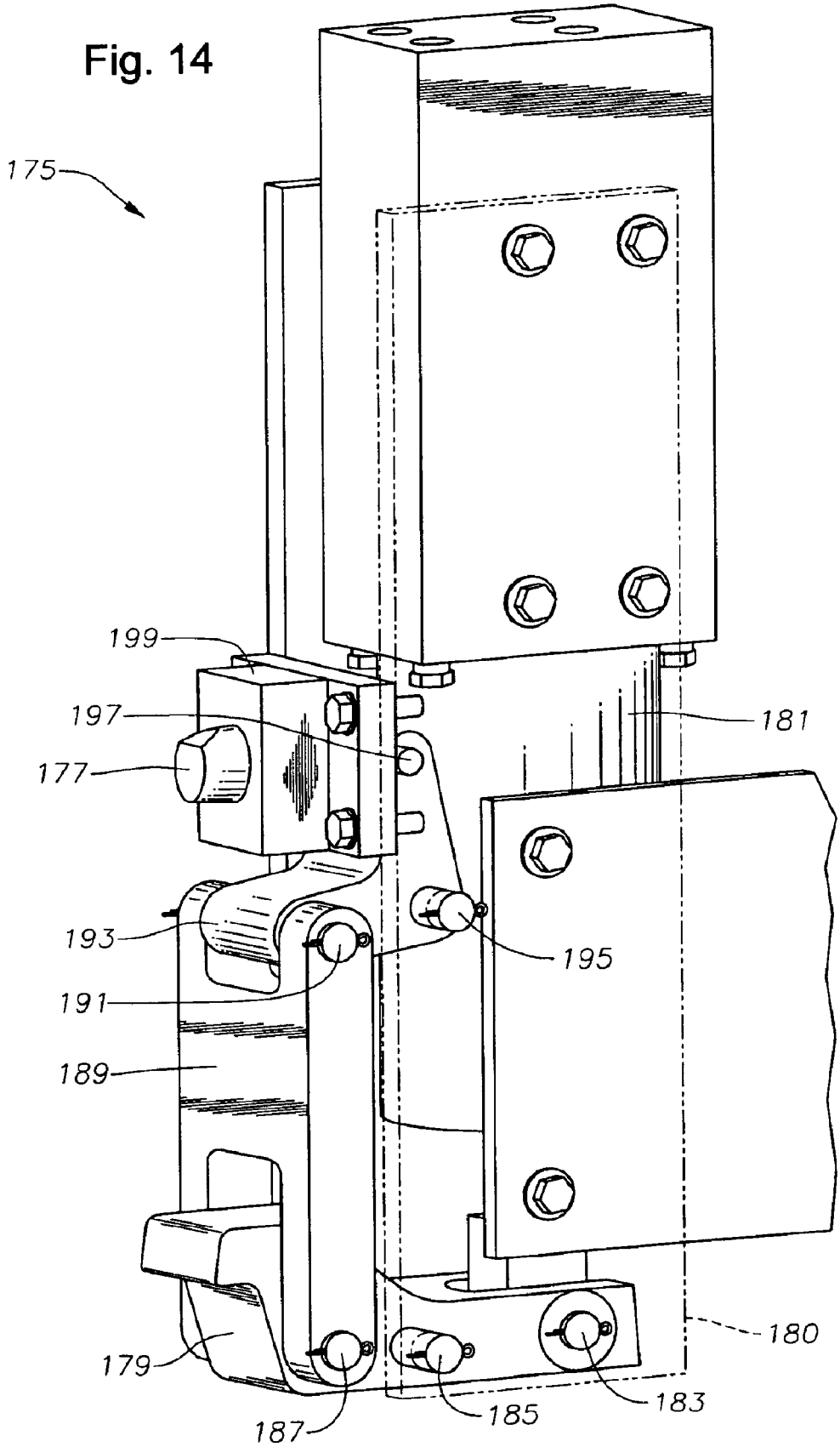
FIG. 14 is a perspective view of the lock mechanism assembly of FIG. 13A.

Referring to FIG. 14, lock mechanism assembly 175 preferably includes an outer casing 180 surrounding a portion of lock assembly 175. Referring to FIGS. 13A–14, lock mechanism assembly 175 includes a piston 181 for selectively actuating lock assembly 175 between locked and unlocked positions. A piston pin 183 connects piston 181 to a portion of lock latch 179 located opposite from the portion that engages upper shoulder 201. A latch pivot pin 185 securely fixes a portion of lock latch 179 located between the portion connected to piston 181 and the portion that engages shoulder 201 to outer casing 182. Lock latch 179 is rotatably connected to pivot pin 185 so that lock latch 179 moves to the unlocked position shown in FIG. 13A when piston 181 pushes piston pin 183 downward. Lock latch 179 rotates about latch pivot pin 185 so that lock latch 179 moves to the locked position shown in FIG. 13B when piston 181 pulls piston pin 183 upward.

A lock latch pin 187 rotatably connects an end portion of a coupler 189 to a portion of lock latch 179 farther from piston pin 183 than latch pivot pin 185. Coupler 189 extends generally upward from lock latch 179 toward lock pin 177. A coupler pin 191 rotatably connects the other end portion of coupler 189 to a lower portion of a lever 193. Lever 193 is substantially an L-shaped member having a lower portion rotatably connected to coupler 189 and an upper portion extending toward an end portion of lock pin 177. A lever pivot pin 195 connects a portion of lever 193 located at an apex of the upper and lower portions of lever 193 to outer casing 182 of lock assembly 175. Lever 193 pivots about lever pivot pin 195 when coupler 189 pushes and pulls on the lower portion of coupler pin 191. Therefore, when piston 191 pushes piston pin 193 downward, coupler 189 pushes the lower and upper portions of lever 193 clockwise around lever pivot pin 195. A lever pin 197 rotatably connects the upper portion of lever 193 with an end portion of lock pin 177. Lock pin 177 extends from the end connected to lever pin 197 through a lock pin housing 199 toward the end of lock pin 177 that engages shoulder 203. Lock pin housing 199 slidingly receives a portion of lock pin 177 while supporting lock pin 177 against vertical movement. Lock pin housing 199 supports lock pin 177 engaging lower shoulder 203 when lock assembly 175 is in the locked position shown in FIG. 13B, preventing stab posts 57 and stab assembly 55 from moving from its upper position.

In the preferred embodiment, an operator can land control pod 21 in guideframe 19 with the only assistance from an ROV being to move control pod 21 to a position above guideframe 19. The operator lowers control pod 21 into guideframe 19, and upon landing, electrical communication is established between electric source 47 in upper portion 43 of control pod 21 with BOP 13, through upper stab and stab plate assemblies 37, 51 without using an ROV. Outer connector panel ports 73 register with upper control panel ports 71 upon landing of control pod 21 in guideframe 19, without assistance from an ROV. The operator actuates piston 181 from a vessel, or with an ROV, to unlock lock mechanism assembly 175. The operator can then actuate piston 59 from the vessel, or with the ROV, to lower stab assembly 55 from its upper position in FIG. 4A to its intermediate position shown in FIG. 4C. Upon moving stab assembly 55 from upper to intermediate positions, lower stab and stab plate assemblies 91, 89 establish electrical communication between electrical source 47 and LMRP 15, with no or minimal use of an ROV. Also upon moving stab assembly 55 to the intermediate position, stab assembly lower ports 87 register with lower control panel ports 85, thereby establishing hydraulic communication between upper portion 43 of control pod 21 with LMRP 15, with no or minimal use of an ROV.

The operator then actuates piston 59, from either a vessel or with an ROV, to lower stab assembly 55 from its intermediate position to its lower position. Upon lowering stab assembly 55 to its lower position, stab assembly upper ports 77 register with inner connector panel ports 75, thereby establishing hydraulic communication between upper portion 43 of control pod 21 with BOP 13, with little or no assistance from an ROV. From a vessel or with an ROV, operator then actuates lock mechanism assembly 175 with piston 191 to engage upper shoulder 201, locking stab assembly 55 in its lower position. Establishing hydraulic communication between control pod 21 and both BOP 13 and LMRP 15 is established through the actuating pistons 59, 191 from a vessel at the surface. Establishing electrical communications between control pod 21 and both BOP 13 and LMRP 15 can be accomplished from a vessel with compliance and alignment assistance from spring rods 99, 139, and stab plates 115, 155. Therefore, the operator no longer has to maneuver an ROV to plug and unplug different cables to establish electrical and hydraulic communications to control the functions of both BOP 13 and LMRP 15. Additionally, by landing and installing a pair of redundant control pods 21 adjacent well assembly 11, the operator can remove one control pod 21 for repairs and maintenance without interrupting well operations.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein or in the steps or in the sequence of steps of the methods described herein without departing from the spirit and the scope of the invention as described. For example, upper control panels 33 could be in communication with both BOP 13 and LMRP 15 while lower control panels communicate with downhole tools and machinery.

What is claimed is:

1. A subsea well drilling assembly, comprising:

a guideframe adapted to be located adjacent a blow-out preventer and a lower marine riser package, the guideframe having an upper portion and a lower portion;

a control pod having an upper portion and a lower portion that is lowered into the guideframe, which is adapted to control the functions of the blow-out preventer and the lower marine riser package;

a pair of upper and lower control panels, each having a plurality of ports, one of the pair of control panels controlling the blow-out preventer, the other of the pair of control panels controlling the lower marine riser package;

a stab assembly on the control pod having an upper portion that selectively registers with the upper control panel and a lower portion that selectively engages the lower control panel, the stab assembly having a plurality of ports on the upper and lower portions of the stab assembly that register with the ports of the upper and lower control panels; and a connector panel located on the control pod for connecting the upper control panel with upper portion of the stab assembly, the connector panel having a stab surface with a plurality of ports that selectively connect to the ports on the upper portion of the stab assembly and a panel surface having a plurality of ports that selectively connect to the ports on the upper control panel.

2. The subsea well drilling assembly of claim 1, further comprising:

a stab plate assembly located adjacent the lower control panel, which is adapted to be in fluid communication with the blow-out preventer; and a stab receptacle located toward the lower portion of the stab assembly of the control pod that is in fluid communication with the upper portion of the control pod, which receives a portion of the stab plate assembly when the lower portion of the control pod registers with the lower control panel.

3. The subsea well drilling assembly of claim 1, further comprising:

an upper stab plate assembly located on the guideframe that is adapted to be in fluid communication with the lower marine riser package; and an upper electric stab mechanism assembly located on the control pod, which receives a portion of the upper stab plate assembly.

4. The subsea well drilling assembly of claim 1, further comprising:

a spring located below the guideframe;

wherein:

the lower control panel is supported by the spring; and the lower portion of the stab assembly selectively engages the lower control panel and compresses the spring in order for the upper portion of the stab assembly to selectively engage the upper control panel.

5. The subsea well drilling assembly of claim 1, further comprising:

an opening located adjacent the upper control panel, the opening having an effective opening cross-section; and wherein:

the lower portion of the stab assembly has an effective lower cross-section that is smaller than the effective opening cross-section so that the lower portion of the stab assembly can extend below the opening and selectively engage the lower control panel, and the upper portion of the stab assembly has an effective upper cross-section that is larger than the effective opening cross-section so that the upper portion of the stab assembly cannot extend below the upper control panel.

6. The subsea well drilling assembly of claim 1, wherein the stab assembly has a lower position in which the upper portion of the stab assembly engages the upper control panel, and an upper position in which the upper portion of the stab assembly is disengaged from the control panel; and further comprising:

a stab lock assembly that selectively engages the stab assembly, the stab lock assembly having a locked position in which the stab lock assembly limits movement of the stab assembly relative to the upper control panel, and an unlocked position in which movement of the stab assembly relative to the upper control panel is not limited by the stab lock assembly.

7. The subsea well drilling assembly of claim 1, wherein the ports on the panel surface of the connector panel connect to the ports on the upper control panel when the control pod is lowered into the guideframe.

8. The subsea well drilling assembly of claim 7, wherein the stab assembly is movable between an upper position and a lower position relative to the control pod, the ports on the upper and lower portions of the stab assembly registering with the ports on the upper and lower control panels when the stab assembly is in the lower position, and the ports on the upper portion of the stab assembly mis-aligning with the ports on the upper control panel when the stab assembly is in the upper position.

9. The subsea well drilling assembly of claim 1, wherein:

there are two upper control panels spaced apart from each other toward the lower end of the guideframe; and the ports on the upper portion of the stab assembly are located on opposite sides of the upper portion of the stab assembly so that the ports on the upper portion of the stab assembly register with the ports on each of the upper control panels.

10. A subsea well drilling assembly, comprising:

a guideframe adapted to be located adjacent a blow-out preventer;

a control pod having an upper portion and a lower portion that is lowered into the guideframe, and which is adapted to control the functions of the blow-out preventer;

a spring located below the guideframe;

a lower control panel that is supported by the spring, and having a plurality of ports for hydraulically controlling the blow-out preventer;

an electrical lower stab plate assembly that is supported by the spring for electrically communicating with the blow-out preventer;

a stab assembly on the control pod, having a plurality of ports that interface with the ports of the lower control panel so that the control pod is in fluid communication with the blow-out preventer, the stab assembly engaging the lower control panel and compressing the spring; and a lower electrical stab mechanism assembly located toward the lower portion of the stab assembly of the control pod, which receives a portion of the lower stab plate assembly when the lower portion of the control pod engages the control panel.

11. The subsea well drilling assembly of claim 10, further comprising:

an upper control panel located on the guideframe that adapted to be in fluid communication with a lower marine riser package; and wherein the stab assembly further comprises a lower portion having a plurality of ports and an upper portion having a plurality of ports, the lower portion engaging the lower control panel and compressing the spring, the ports on the upper portion of the stab assembly registering with the plurality of ports on the upper control panel upon compression of the spring.

12. The subsea well drilling assembly of claim 10, further comprising:

an upper stab plate assembly on the guideframe that is adapted to be in electrical communication with a lower marine riser package;

an upper electric stab mechanism assembly on the control pod, which receives a portion of the upper stab plate assembly.

13. The subsea well drilling assembly of claim 10, further comprising:

an opening located toward the lower portion of the control pod with an effective opening cross-section;

wherein the stab assembly further comprises a lower portion having a plurality of ports and an upper portion, the lower portion of the stab assembly engaging the lower control panel and compressing the spring; and wherein the lower portion of the stab assembly has an effective lower cross-section that is smaller than the effective opening cross-section so that the lower portion of the stab assembly extends through opening and engages the lower control panel, and the upper portion of the stab assembly has an effective upper cross-section that is larger than the effective opening cross-section.

14. The subsea well drilling assembly of claim 10, further comprising:

a stab lock assembly located on the control pod that selectively engages the stab assembly to limit movement of the stab assembly relative to the lower control panel;

wherein the stab assembly has a lower portion, and a stab assembly lower position is defined by the lower portion of the stab assembly compressing the spring; and wherein the stab lock assembly is engaging the stab assembly when the stab assembly is in the lower position so that the stab assembly continues engaging the lower control panel and compressing the spring.

15. The subsea well drilling assembly of claim 10, further comprising:

a support member located below the guideframe, the support member supporting the lower stab plate assembly and the lower control panel and connecting the lower stab plate assembly and lower control panel to the spring.

16. The subsea well drilling assembly of claim 15, wherein the lower stab plate assembly further comprises:

a support plate that is connected to the support member;

a stab plate that slidingly engages an upper surface of the support plate; and a tubular post connected to the stab plate for receiving a portion of the lower electrical stab mechanism assembly on the stab assembly, the tubular post being in electrical communication with the blow-out preventer.

17. The subsea well drilling assembly of claim 16, wherein the lower electrical stab mechanism assembly further comprises:

an electric stab located inside of an outer casing that is in electrical communication with the upper portion of the control pod; and a springpost that is connected to the outer casing, the springpost is offset from the outer casing and engaging the stab plate thereby compressing springpost to maintain the position of the outer casing relative to the stab plate as the stab assembly moves closer to the support plate after the springpost engages the stab plate.

18. A subsea well drilling assembly, comprising:

a guideframe having a pair of spaced apart lower control panels with inclined inner faces that face each other and having a plurality of ports;

a control pod that is lowered into the guideframe and is adapted to control the functions of a blow-out preventer and a lower marine riser package;

a pair of spaced apart upper control panels on the guideframe above the lower control panels, the upper control panels having inclined inner faces that face each other and having a plurality of ports;

a pair of panel connectors on the control pod, each having inclined outer faces with a plurality of ports that register with the ports of the inner faces of the upper control panels when the control pod lands in the guideframe, each of the panel connectors also having inclined inner faces with a plurality of ports that face each other;

a stab assembly mounted to the control pod for movement between upper and lower positions relative to the panel connectors;

a pair of lower outer faces on the stab assembly, each being inclined and having a plurality of ports for registering with the ports of the inner faces of the lower control panels when the stab assembly moves to the lower position; and a pair of upper outer faces on the stab assembly, each being inclined and having a plurality of ports for registering with the ports of the inner faces of the panel connectors when the stab assembly is in the lower position.

19. The subsea well drilling assembly of claim 18, further comprising:

a lower stab plate assembly located below the guideframe, which is adapted to be in electrical communication with the blow-out preventer; and a lower electrical stab mechanism assembly located toward the lower portion of the stab assembly of the control pod that is in electrical communication with the control pod, and which engages the lower stab plate assembly when the lower portion of the control pod extends through the opening.

20. The subsea well drilling assembly of claim 18, further comprising:

an upper stab plate assembly located toward the upper portion of the guideframe that is adapted to be in fluid communication with the lower marine riser package; and an upper electric stab mechanism assembly on the control pod, which receives a portion of the upper stab plate assembly.

21. The subsea well drilling assembly of claim 18, further comprising:

a spring located below the guideframe and supports the lower control panels, the spring being compressed by the stab assembly when the stab assembly is in the lower position;

wherein:

the ports on the pair of lower outer faces on the stab assembly register with the ports of the inner faces of the lower control panels while the stab assembly is in an intermediate position relative to the panel connectors that is between the upper and lower positions and before compressing the spring; and the ports on the pair of upper outer faces on the stab assembly register with the ports on the inner faces of the panel connectors after the stab assembly compresses the spring.

22. The subsea well drilling assembly of claim 18, further comprising a stab lock assembly that selectively engages the stab assembly, the stab lock assembly having a locked position in which the stab lock assembly limits movement of the stab assembly relative to the connector panels, and an unlocked position in which movement of the stab assembly relative to the connector panels is not limited by the stab lock assembly.

23. A subsea well drilling assembly, comprising:

a blow-out preventer;

a lower marine riser package;

a guideframe located adjacent the blow-out preventer and the lower marine riser package;

an upper stab plate assembly on a side of the guideframe, which is in fluid communication with the lower marine riser package;

a lower stab plate assembly located below the guideframe that is in fluid communication with blow-out preventer;

a control pod that is lowered into the guideframe for controlling the functions of the blow-out preventer and the lower marine riser package;

an upper electric stab mechanism assembly on a side of the control pod and receives a portion of the upper stab plate assembly so that the control pod is in fluid communication with the lower marine riser package;

a control pod stab assembly on the control pod that is in fluid communication with the upper portion of the control pod, the control pod stab assembly having a lower portion that selectively extends below the guideframe;

a lower electrical stab mechanism assembly located toward the lower portion of the control pod stab assembly that receives a portion of the lower stab plate assembly so that the control pod is in fluid communication with the blow-out preventer;

a pair of upper and lower control panels, each having a plurality of ports, one of the pair of control panels controlling the blow-out preventer, the other of the pair of control panels controlling the lower marine riser package; and wherein the control pod stab assembly has an upper portion that selectively registers with the upper control panel and a lower portion that selectively engages the lower control panel when the lower portion of the control pod stab assembly extends below the guideframe, the control pod stab assembly having a plurality of ports that interface with the ports of the upper and lower control panels so that the control pod is in fluid communication with the lower marine riser package and the blow-out preventer.

24. The subsea well drilling assembly of claim 23, further comprising:

a spring located below the guideframe;

the lower control panels supported by the spring and located below the guideframe, the lower control panels being in fluid communication with the blow-out preventer;

the upper control panels located on the control pod that are in fluid communication with the lower marine riser package;

wherein the lower portion of the control pod stab assembly engages the lower control panel and compresses the spring when the lower portion of the control pod stab assembly extends below the guideframe; and wherein the control pod stab assembly has an upper portion that selectively engages the upper control panel when the lower portion of the control pod stab assembly compresses the spring.

25. The subsea well drilling assembly of claim 23, further comprising:

an opening located toward the lower portion of the control pod with an effective opening cross-section; and wherein the control pod stab assembly having an upper portion and a lower portion, the lower portion of the control pod stab assembly having an effective lower cross-section that is smaller than the effective opening cross-section of the control pod so that the lower portion of the stab assembly selectively extends through the opening to an elevation below the control pod, the upper portion of the control pod stab assembly having an effective upper cross-section that is larger than the effective opening cross-section of the control pod so that the upper portion engages the opening, the lower portion of the stab assembly fluidly connecting the control pod with the blow-out preventer when the upper portion of the stab assembly engages the opening.

26. The subsea well drilling assembly of claim 23, wherein the control pod stab assembly has a lower position relative to the control pod in which the lower electrical stab mechanism assembly engages the lower stab plate assembly, and an upper position relative to the control pod in which the lower electrical stab mechanism assembly is disengaged from the lower stab plate assembly;

further comprising:

a stab lock assembly that selectively engages the control pod stab assembly, the stab lock assembly having a locked position in which the stab lock assembly limits movement of the control pod stab assembly relative to the lower electrical stab mechanism assembly, and an unlocked position in which movement of the control pod stab assembly relative to the lower electrical stab mechanism assembly is not limited by the stab lock assembly.

27. A subsea well drilling assembly, comprising:

a guideframe adapted to be located adjacent a blow-out preventer;

a control pod that is lowered into the guideframe, and which is adapted to control the functions of the blow-out preventer;

a lower control panel located below the guideframe that is in fluid communication with the blow-out preventer;

a stab assembly on the control pod having a lower portion that selectively engages the control panel so that the lower portion of the control pod is in fluid communication with the blow-out preventer, the stab assembly having a lower position relative to the control panel in which the lower portion of the stab assembly engages the control panel and an upper position relative to the control panel in which the lower portion of the stab assembly does not engage the control panel;

a stab lock assembly that selectively engages the stab assembly, the stab lock assembly having a locked position in which the stab lock assembly limits movement of the stab assembly relative to the control panel, and an unlocked position in which the stab lock assembly allows movement of the stab assembly relative to the control panel; and a lower stab plate assembly located below the guideframe, which is adapted to be in electrical communication with the blow-out preventer; and a lower electrical stab mechanism assembly located toward the lower portion of the stab assembly of the control nod and which receives a portion of the lower stab plate assembly when the lower portion of the stab assembly extends through an opening of the control pod.

28. The subsea well drilling assembly of claim 27, wherein:

the opening is located toward the lower portion of the control pod with an effective opening cross-section; and the stab assembly also has an upper portion, the lower portion of the stab assembly having an effective lower cross-section that is smaller than the effective opening cross-section of the opening so that the lower portion of the stab assembly selectively extends through the opening to the lower position of the stab assembly, the upper portion of the stab assembly having an effective upper cross-section that is larger than the effective opening cross-section of the opening, the upper portion of the stab assembly engages the opening when the stab assembly is in its lower position.

29. The subsea well drilling assembly of claim 27, further comprising:

an upper stab plate assembly located toward the upper portion of the guideframe that is adapted to be in electrical communication with a lower marine riser package; and an upper electric stab mechanism assembly on a side of the control pod and receives a portion of the upper stab plate assembly so that the upper portion of the control pod is in electrical communication with the lower marine riser package.

30. The subsea well drilling assembly of claim 27, further comprising:

a spring located below the guideframe that supports the lower control panel;

an upper control panel being located adjacent the opening and adapted to be in fluid communication with the lower marine riser package; and wherein the stab assembly has an upper portion of the stab assembly that registers with the upper control panel when the lower portion of stab assembly engages the lower control panel and compresses the spring.

31. The subsea well drilling assembly of claim 27, wherein the stab assembly further comprises a sleeve connected to the upper portion of the stab assembly, that extends above the upper portion of the stab assembly; and wherein the stab lock assembly engages the sleeve when in the locked position.

32. The subsea well drilling assembly of claim 27, wherein the stab assembly further comprises a stab post connected to the upper portion of the stab assembly, that extends above the upper portion of the stab assembly;

and further comprising:

a downward facing lip located on a lower portion of the stab post;

an upward facing shoulder on an upper portion of the stab post; and wherein the stab lock assembly engages the lip when the stab assembly is in the upper position and when the stab lock assembly is in the locked position, and the stab lock assembly engages the shoulder when the stab assembly is in the lower position and when the stab lock assembly is in the locked position.

33. The subsea well drilling assembly of claim 27, wherein the stab lock assembly further comprises:

a lock pin that is selectively extends outward from the stab lock assembly when the stab lock assembly is actuated to the locked position; and a lock latch having a portion that selectively extends outward from the stab lock assembly is actuated to the locked position.

34. The subsea well drilling assembly of claim 33, further comprising a coupler assembly that connects to the lock pin and the lock latch so that actuating the lock latch between locked and unlocked positions also actuates the lock pin between locked and unlocked positions.

35. The subsea well drilling assembly of claim 27, wherein the stab assembly further comprises a sleeve connected to the upper portion of the stab assembly, that extends above the upper portion of the stab assembly;

and further comprising:

a downward facing lip located on a lower portion of the stab post;

an upward facing shoulder on an upper portion of the stab post; and a lock pin that selectively extends outward from the stab lock assembly when the stab lock assembly is actuated to the locked position, the lock pin engaging the lip when the when the stab assembly is in the upper position and when the stab lock assembly is in the locked position; and a lock latch having a portion that selectively extends outward from the stab lock assembly when actuated to the locked position, the lock latch engaging the shoulder when the stab assembly is in the lower position and when the stab lock assembly is in the locked position.

36. A method for controlling a subsea well assembly, comprising the steps:

(a) providing a guideframe fluidly communicating with a blowout preventer and a lower marine riser package, a control pod that lands in the guideframe, and a stab assembly that is supported by the control pod and is electrically and hydraulically communicating with the control pod; then (b) locating an upper electrical stab communicating with the control pod on a side of the control pod and an upper electrical stab plate that is in electrical communication with the lower marine riser package on a side of the guideframe;

(c) locating an upper control panel on the guideframe that hydraulically communicates with the lower marine riser package, and a lower control panel below the upper control panel that hydraulically communicates with the blow-out preventer; then (d) locating a lower electrical stab communicating with the control pod in the stab assembly and a lower electrical stab plate that is in electrical communication with the blow-out preventer adjacent the lower control panel;

(e) connecting the upper electrical stab and the upper electrical stab plate by landing the control pod in the guideframe so that the lower marine riser package electrically registers with the control pod; and then (f) stabbing the stab assembly that is in electric and hydraulic communication with the control pod so that the bow-out preventer and the lower marine riser package register hydraulically with the control pod, and the blow-out preventer registers electrically with the control.

37. A method for controlling a subsea well assembly, comprising the steps:

(a) providing a guide frame having a pair of spaced apart lower control panels with inner faces that face each other and have a plurality of ports and a pair of spaced apart upper control panels above the lower control panels having inner faces that face each other and having a plurality of ports; then (b) lowering a control pod that is adapted to control the functions of a blow-out preventer and a lower marine riser package into the guideframe; then (c) placing a pair of panel connectors with inner and outer faces with hydraulic ports on the control pod; then (d) registering the hydraulic ports on the outer faces of the control panels with the ports of the inner faces of the upper control panels by landing the control pod in the guideframe; then (e) placing on the control pod a stab assembly that moves relative to the connector panels which has a pair of lower outer faces with a plurality of ports and a pair of upper outer faces a plurality of ports; then (f) registering the ports of the lower outer faces of the stab assembly with the ports of the inner faces of the lower control panels by lowering the stab assembly from an upper position to an intermediate position; and then (g) registering the ports of the upper outer faces of the stab assembly with the ports of the inner faces of the connector panels by lowering the stab assembly from the intermediate position to a lower position.

* * * * *